US008246443B2

(12) United States Patent
Randall

(10) Patent No.: US 8,246,443 B2
(45) Date of Patent: Aug. 21, 2012

(54) GAMING SYSTEM HAVING A PLURALITY OF SIMULTANEOUSLY PLAYED WAGERING GAMES THAT MAY TRIGGER A PLURALITY OF FREE GAMES WHICH MAY BE PLAYED SIMULTANEOUSLY WITH THE WAGERING GAMES

(75) Inventor: Dov Liam Randall, Las Vegas, NV (US)

(73) Assignee: IGT, Reno, NV (US)

( * ) Notice: Subject to any disclaimer, the term of this patent is extended or adjusted under 35 U.S.C. 154(b) by 273 days.

(21) Appl. No.: 12/786,744

(22) Filed: May 25, 2010

(65) Prior Publication Data

US 2010/0261518 A1 Oct. 14, 2010

Related U.S. Application Data

(63) Continuation of application No. 11/847,995, filed on Aug. 30, 2007, now Pat. No. 7,758,416.

(60) Provisional application No. 60/825,038, filed on Sep. 8, 2006.

(51) Int. Cl.
*A63F 9/24* (2006.01)

(52) U.S. Cl. ..... 463/20; 463/25

(58) Field of Classification Search ..... 463/20, 463/25

See application file for complete search history.

(56) References Cited

U.S. PATENT DOCUMENTS 4,621,814 A 11/1986 Stepan et al.
4,624,459 A 11/1986 Kaufman
4,669,731 A 6/1987 Clarke
4,695,053 A 9/1987 Vazquez, Jr. et al.
4,805,907 A 2/1989 Hagiwara
4,838,552 A 6/1989 Hagiwara
4,856,787 A 8/1989 Itkis
4,991,848 A 2/1991 Greenwood et al.
5,046,735 A 9/1991 Hamano et al.
5,152,529 A 10/1992 Okada
5,178,395 A 1/1993 Lovell
5,205,555 A 4/1993 Hamano
5,342,047 A 8/1994 Heidel et al.
5,342,049 A 8/1994 Wichinsky
5,375,830 A 12/1994 Takemoto et al.
5,393,057 A 2/1995 Marnell, II (Continued)

FOREIGN PATENT DOCUMENTS

EP 0 558 307 9/1993

(Continued)

OTHER PUBLICATIONS

50 Lions Article, written by Aristocrat Technologies, published in Apr. 2005.

(Continued)

*Primary Examiner* — Michael Cuff

(74) *Attorney, Agent, or Firm* — Neal, Gerber & Eisenberg LLP

(57) ABSTRACT

The present disclosure provides a gaming machine or gaming system having a plurality of games which each can be provided as a wagering game or as a free game. The gaming machine or gaming system enables the player to wager on and simultaneously play the plurality of the games. If any free games are won by the player during the played games, the gaming machine or gaming system enables the player to wager on one or more of the games and to play one or more of the games as a wagering game, while simultaneously playing one or more of the games as a free game.

21 Claims, 33 Drawing Sheets

U.S. PATENT DOCUMENTS

| | | | |
|---|---|---|---|
| 5,393,061 | A | 2/1995 | Manship et al. |
| 5,395,111 | A | 3/1995 | Inoue |
| 5,395,119 | A | 3/1995 | Jacob et al. |
| 5,397,125 | A | 3/1995 | Adams |
| 5,407,200 | A | 4/1995 | Zalabak |
| 5,423,539 | A | 6/1995 | Nagao |
| 5,449,173 | A | 9/1995 | Thomas et al. |
| 5,456,465 | A | 10/1995 | Durham |
| 5,542,669 | A | 8/1996 | Charron et al. |
| 5,544,892 | A | 8/1996 | Breeding |
| 5,560,603 | A | 10/1996 | Seelig et al. |
| 5,584,764 | A | 12/1996 | Inoue |
| 5,611,535 | A | 3/1997 | Tiberio |
| 5,647,798 | A | 7/1997 | Falciglia |
| 5,655,961 | A | 8/1997 | Acres et al. |
| 5,664,998 | A | 9/1997 | Seelig et al. |
| 5,678,821 | A | 10/1997 | Hedman |
| 5,695,402 | A | 12/1997 | Stupak |
| 5,711,525 | A | 1/1998 | Breeding |
| 5,722,891 | A | 3/1998 | Inoue |
| 5,732,950 | A | 3/1998 | Moody |
| 5,772,506 | A | 6/1998 | Marks et al. |
| 5,772,509 | A | 6/1998 | Weiss |
| 5,775,692 | A | 7/1998 | Watts et al. |
| 5,779,544 | A | 7/1998 | Seelig et al. |
| 5,806,847 | A | 9/1998 | White et al. |
| 5,807,172 | A | 9/1998 | Piechowiak |
| 5,823,873 | A | 10/1998 | Moody |
| 5,823,874 | A | 10/1998 | Adams |
| 5,830,068 | A | 11/1998 | Brenner et al. |
| 5,833,537 | A | 11/1998 | Barrie |
| 5,848,932 | A | 12/1998 | Adams |
| 5,851,148 | A | 12/1998 | Brune et al. |
| 5,855,514 | A | 1/1999 | Kamille |
| 5,876,284 | A | 3/1999 | Acres et al. |
| 5,882,261 | A | 3/1999 | Adams |
| 5,911,418 | A | 6/1999 | Adams |
| 5,918,880 | A | 7/1999 | Voigt, IV et al. |
| 5,919,088 | A | 7/1999 | Weiss |
| 5,935,002 | A | 8/1999 | Falciglia |
| 5,947,820 | A | 9/1999 | Morro et al. |
| 5,951,397 | A | 9/1999 | Dickinson |
| 5,954,335 | A | 9/1999 | Moody |
| 5,964,463 | A | 10/1999 | Moore, Jr. |
| 5,971,849 | A | 10/1999 | Falciglia |
| 5,976,015 | A | 11/1999 | Seelig et al. |
| 5,976,016 | A | 11/1999 | Moody et al. |
| 5,980,384 | A | 11/1999 | Barrie |
| 5,984,781 | A | 11/1999 | Sunaga |
| 5,984,782 | A | 11/1999 | Inoue |
| 5,988,638 | A | 11/1999 | Rodesch et al. |
| 5,997,400 | A | 12/1999 | Seelig et al. |
| 5,997,401 | A | 12/1999 | Crawford |
| 6,003,867 | A | 12/1999 | Rodesch et al. |
| 6,004,207 | A | 12/1999 | Wilson, Jr. et al. |
| 6,007,066 | A | 12/1999 | Moody |
| 6,012,982 | A | 1/2000 | Piechowiak et al. |
| 6,012,983 | A | 1/2000 | Walker et al. |
| 6,015,346 | A | 1/2000 | Bennett |
| 6,019,374 | A | 2/2000 | Breeding |
| 6,056,642 | A | 5/2000 | Bennett |
| 6,059,289 | A | 5/2000 | Vancura |
| 6,059,658 | A | 5/2000 | Mangano et al. |
| 6,062,980 | A | 5/2000 | Luciano |
| 6,079,711 | A | 6/2000 | Wei et al. |
| 6,079,712 | A | 6/2000 | Eaton et al. |
| 6,089,976 | A | 7/2000 | Schneider et al. |
| 6,089,977 | A | 7/2000 | Bennett |
| 6,089,978 | A | 7/2000 | Adams |
| 6,093,102 | A | 7/2000 | Bennett |
| 6,098,985 | A | 8/2000 | Moody |
| 6,102,400 | A | 8/2000 | Scott et al. |
| 6,102,798 | A | 8/2000 | Bennett |
| 6,110,041 | A | 8/2000 | Walker et al. |
| 6,113,098 | A | 9/2000 | Adams |
| 6,120,378 | A | 9/2000 | Moody et al. |
| 6,126,541 | A | 10/2000 | Fuchs |
| 6,126,542 | A | 10/2000 | Fier |
| 6,135,884 | A | 10/2000 | Hedrick et al. |
| 6,142,873 | A | 11/2000 | Weiss et al. |
| 6,142,874 | A | 11/2000 | Kodachi et al. |
| 6,142,875 | A | 11/2000 | Kodachi et al. |
| 6,155,925 | A | 12/2000 | Giobbi et al. |
| 6,159,095 | A | 12/2000 | Frohm et al. |
| 6,159,097 | A | 12/2000 | Gura |
| 6,159,098 | A | 12/2000 | Slomiany et al. |
| 6,162,121 | A | 12/2000 | Morro et al. |
| 6,168,520 | B1 | 1/2001 | Baerlocher et al. |
| 6,168,523 | B1 | 1/2001 | Piechowiak et al. |
| 6,173,955 | B1 | 1/2001 | Perrie et al. |
| 6,174,233 | B1 | 1/2001 | Sunaga et al. |
| 6,186,894 | B1 | 2/2001 | Mayeroff |
| 6,190,254 | B1 | 2/2001 | Bennett |
| 6,190,255 | B1 | 2/2001 | Thomas et al. |
| 6,203,428 | B1 | 3/2001 | Giobbi et al. |
| 6,203,429 | B1 | 3/2001 | Demar et al. |
| 6,210,275 | B1 | 4/2001 | Olsen |
| 6,217,448 | B1 | 4/2001 | Olsen |
| 6,220,959 | B1 | 4/2001 | Holmes, Jr. et al. |
| 6,224,482 | B1 | 5/2001 | Bennett |
| 6,224,483 | B1 | 5/2001 | Mayeroff |
| 6,227,969 | B1 | 5/2001 | Yoseloff |
| 6,227,971 | B1 | 5/2001 | Weiss |
| 6,231,442 | B1 | 5/2001 | Mayeroff |
| 6,231,445 | B1 | 5/2001 | Acres |
| 6,234,879 | B1 | 5/2001 | Hasegawa et al. |
| 6,234,897 | B1 | 5/2001 | Frohm et al. |
| 6,241,608 | B1 | 6/2001 | Torango |
| 6,251,013 | B1 | 6/2001 | Bennett |
| 6,261,128 | B1 | 7/2001 | Heim et al. |
| 6,261,177 | B1 | 7/2001 | Bennett |
| 6,270,409 | B1 | 8/2001 | Shuster |
| 6,270,411 | B1 | 8/2001 | Gura et al. |
| 6,270,412 | B1 | 8/2001 | Crawford et al. |
| 6,299,165 | B1 | 10/2001 | Nagano |
| 6,302,396 | B1 | 10/2001 | Eaton et al. |
| 6,302,790 | B1 | 10/2001 | Brossard |
| 6,305,686 | B1 | 10/2001 | Perrie et al. |
| 6,309,300 | B1 | 10/2001 | Glavich |
| 6,311,976 | B1 | 11/2001 | Yoseloff et al. |
| 6,311,978 | B1 | 11/2001 | Moody |
| 6,312,334 | B1 | 11/2001 | Yoseloff |
| 6,315,291 | B1 | 11/2001 | Moody |
| 6,315,660 | B1 | 11/2001 | DeMar et al. |
| 6,315,662 | B1 | 11/2001 | Jorasch et al. |
| 6,315,663 | B1 | 11/2001 | Sakamoto |
| 6,328,649 | B1 | 12/2001 | Randall et al. |
| 6,334,614 | B1 | 1/2002 | Breeding |
| 6,334,864 | B1 | 1/2002 | Amplatz et al. |
| 6,340,158 | B2 | 1/2002 | Pierce et al. |
| 6,347,996 | B1 | 2/2002 | Gilmore et al. |
| 6,364,313 | B1 | 4/2002 | Moody |
| 6,364,766 | B1 | 4/2002 | Anderson et al. |
| 6,364,768 | B1 | 4/2002 | Acres et al. |
| 6,368,214 | B1 | 4/2002 | Luciano |
| 6,394,899 | B1 | 5/2002 | Walker |
| 6,394,902 | B1 | 5/2002 | Glavich et al. |
| 6,398,218 | B1 | 6/2002 | Vancura |
| 6,398,644 | B1 | 6/2002 | Perrie et al. |
| 6,398,645 | B1 | 6/2002 | Yoseloff |
| 6,416,408 | B2 | 7/2002 | Tracy et al. |
| 6,435,968 | B1 | 8/2002 | Torango |
| 6,439,993 | B1 | 8/2002 | O'Halloran |
| 6,443,452 | B1 | 9/2002 | Brune |
| 6,443,456 | B1 | 9/2002 | Gajor |
| 6,461,241 | B1 | 10/2002 | Webb et al. |
| 6,471,208 | B2 | 10/2002 | Yoseloff et al. |
| 6,481,713 | B2 | 11/2002 | Perrie et al. |
| 6,491,584 | B2 | 12/2002 | Graham et al. |
| 6,503,145 | B1 | 1/2003 | Webb |
| 6,511,068 | B1 | 1/2003 | Sklansky et al. |
| 6,517,432 | B1 | 2/2003 | Jaffe |
| 6,533,279 | B2 | 3/2003 | Moody et al. |
| 6,537,150 | B1 | 3/2003 | Luciano et al. |
| 6,537,152 | B2 | 3/2003 | Seelig et al. |
| 6,550,772 | B1 | 4/2003 | Streeks al. |
| 6,551,187 | B1 | 4/2003 | Jaffe |

6,561,904 B2 5/2003 Locke et al.
6,565,436 B1 5/2003 Baerlocher
6,592,460 B2 7/2003 Torango
6,599,185 B1 7/2003 Kaminkow et al.
6,602,136 B1 8/2003 Baerlocher et al.
6,602,137 B2 8/2003 Kaminkow et al.
6,604,740 B1 8/2003 Singer et al.
6,648,753 B1 11/2003 Tracy et al.
6,652,377 B1 11/2003 Moody
6,652,378 B2 11/2003 Cannon et al.
6,656,040 B1 12/2003 Brosnan et al.
6,656,044 B1 12/2003 Lewis
6,663,489 B2 12/2003 Baerlocher
6,695,696 B1 2/2004 Kaminkow
6,705,944 B2 3/2004 Luciano
6,712,694 B1 3/2004 Nordman
6,733,389 B2 5/2004 Webb et al.
6,776,711 B1 8/2004 Baerlocher
6,780,105 B1 8/2004 Kaminkow
6,780,111 B2 8/2004 Cannon et al.
6,786,819 B2 9/2004 Baerlocher et al.
6,805,349 B2 10/2004 Baerlocher et al.
6,811,483 B1 11/2004 Webb et al.
6,837,788 B2 1/2005 Cannon
6,855,052 B2 2/2005 Weiss et al.
6,860,810 B2 3/2005 Cannon et al.
6,869,360 B2 3/2005 Marks et al.
6,878,060 B2 4/2005 Moody
6,887,157 B2 5/2005 LeMay et al.
6,890,254 B2 5/2005 Kaminkow
6,890,255 B2 5/2005 Jarvis et al.
6,890,257 B2 5/2005 Baerlocher
6,899,620 B2 5/2005 Kaminkow et al.
6,905,406 B2 6/2005 Kaminkow et al.
6,908,383 B2 6/2005 Baerlocher et al.
6,913,532 B2 7/2005 Baerlocher et al.
6,916,245 B1 7/2005 Vancura et al.
6,921,335 B2 7/2005 Rodgers et al.
6,955,356 B2 10/2005 Moody
6,955,600 B2 10/2005 Glavich et al.
6,960,134 B2 11/2005 Hartl et al.
6,964,418 B2 11/2005 Moody
7,004,835 B2 2/2006 Baerlocher
7,029,395 B1 4/2006 Baerlocher
7,037,190 B2 5/2006 Moody et al.
7,052,395 B2 5/2006 Glavich et al.
7,056,213 B2 6/2006 Ching et al.
7,066,814 B2 6/2006 Glavich et al.
7,070,505 B2 7/2006 Vancura et al.
7,074,127 B2 7/2006 Cuddy et al.
7,077,746 B2 7/2006 Torango
7,090,580 B2 8/2006 Rodgers et al.
7,094,148 B2 8/2006 Baerlocher et al.
7,121,942 B2 10/2006 Baerlocher
7,137,628 B2 11/2006 Moody
7,147,559 B2 12/2006 Englman
7,156,741 B2 1/2007 Hornik et al.
7,169,042 B2 1/2007 Muir et al.
7,175,522 B2 2/2007 Hartl
7,198,570 B2 4/2007 Rodgers et al.
7,204,757 B2 4/2007 Newton et al.
7,222,857 B2 5/2007 Moody
7,222,858 B2 5/2007 Moody
7,235,011 B2 6/2007 Randall et al.
7,238,108 B2 7/2007 Webb
7,238,110 B2 7/2007 Glavich et al.
7,252,591 B2 8/2007 Van Asdale
7,258,611 B2 8/2007 Bigelow, Jr. et al.
7,300,347 B1 11/2007 Forbes
7,300,348 B2 11/2007 Kaminkow et al.
7,300,351 B2 11/2007 Thomas
7,306,517 B1 12/2007 Forbes
7,322,887 B2 1/2008 Belger et al.
7,326,109 B2 2/2008 Baerlocher
7,326,115 B2 2/2008 Baerlocher
7,329,179 B2 2/2008 Baerlocher
7,331,859 B2 2/2008 Hornik et al.
7,331,862 B2 2/2008 Rodgers et al.
7,331,866 B2 2/2008 Rodgers et al.
7,331,867 B2 2/2008 Baerlocher et al.
7,341,513 B2 3/2008 Cuddy et al.
7,357,714 B2 4/2008 Tessmer et al.
7,357,716 B2 4/2008 Marks et al.
7,381,134 B2 6/2008 Cuddy et al.
7,384,334 B2 6/2008 Glavich et al.
7,402,103 B2 7/2008 Baerlocher
7,473,174 B2 1/2009 Cuddy et al.
7,481,708 B2 1/2009 Baerlocher et al.
2001/0009865 A1 7/2001 Demar et al.
2002/0010017 A1 1/2002 Bennett
2002/0039923 A1 4/2002 Cannon et al.
2002/0052233 A1 5/2002 Gauselmann
2003/0022712 A1 1/2003 Locke
2003/0032479 A1 2/2003 LeMay et al.
2003/0060268 A1 3/2003 Falconer
2003/0060272 A1 3/2003 Glavich et al.
2003/0069056 A1 4/2003 Cormack et al.
2003/0073483 A1 4/2003 Glavich et al.
2003/0148804 A1 8/2003 Ikeya et al.
2003/0162585 A1 8/2003 Bigelow, Jr. et al.
2003/0183105 A1 10/2003 Riepenhoff et al.
2003/0203753 A1 10/2003 Muir et al.
2004/0002372 A1 1/2004 Rodgers et al.
2004/0023708 A1 2/2004 Kaminkow et al.
2004/0038731 A1 2/2004 Englman
2004/0043815 A1 3/2004 Kaminkow
2004/0048649 A1 3/2004 Peterson et al.
2004/0053666 A1 3/2004 Vancura
2004/0053669 A1 3/2004 Gerrard et al.
2004/0053672 A1 3/2004 Baerlocher
2004/0063493 A1 4/2004 Baerlocher
2004/0072612 A1 4/2004 Rodgers et al.
2004/0072619 A1 4/2004 Brosnan et al.
2004/0087359 A1 5/2004 Cuddy et al.
2004/0106446 A1 6/2004 Cannon et al.
2004/0137982 A1 7/2004 Cuddy et al.
2004/0147306 A1 7/2004 Randall et al.
2004/0152500 A1 8/2004 Baerlocher
2004/0192431 A1 9/2004 Singer et al.
2004/0242302 A1 12/2004 Baerlocher
2004/0266512 A1 12/2004 Kaminkow
2004/0266516 A1 12/2004 Thomas
2004/0266517 A1 12/2004 Bleich et al.
2005/0020346 A1 1/2005 Baerlocher
2005/0032566 A1 2/2005 Baerlocher et al.
2005/0049035 A1 3/2005 Baerlocher et al.
2005/0054429 A1 3/2005 Baerlocher et al.
2005/0070354 A1 3/2005 Baerlocher et al.
2005/0075163 A1 4/2005 Cuddy et al.
2005/0101379 A1 5/2005 Falconer
2005/0181860 A1 8/2005 Nguyen et al.
2005/0187011 A1 8/2005 Kaminkow
2005/0192081 A1 9/2005 Marks et al.
2005/0197180 A1 9/2005 Kaminkow et al.
2005/0233794 A1 10/2005 Cannon et al.
2005/0233796 A1 10/2005 Baerlocher et al.
2005/0233801 A1 10/2005 Baerlocher et al.
2005/0266917 A1 12/2005 Glavich et al.
2006/0003827 A1 1/2006 Hartl et al.
2006/0009277 A1 1/2006 Hartl et al.
2006/0063585 A1 3/2006 Cuddy
2006/0068884 A1 3/2006 Baerlocher et al.
2006/0068885 A1 3/2006 Cregan et al.
2006/0073876 A1 4/2006 Cuddy
2006/0084494 A1 4/2006 Belger et al.
2006/0199636 A1 9/2006 Ching et al.
2006/0199637 A1 9/2006 Ching et al.
2006/0205480 A1 9/2006 Glavich et al.
2006/0246989 A1 11/2006 Glavich et al.
2007/0004489 A1 1/2007 Rodgers et al.
2007/0010316 A1 1/2007 Baerlocher et al.
2007/0021175 A1 1/2007 Rodgers et al.
2007/0021188 A1 1/2007 Rodgers et al.
2007/0049372 A1 3/2007 Olivas et al.
2007/0060294 A1 3/2007 Cuddy et al.
2007/0060300 A1 3/2007 Baerlocher
2007/0087809 A1 4/2007 Baerlocher
2007/0099688 A1 5/2007 Brosnan et al.

| | | | |
|---|---|---|---|
| 2007/0111774 | A1 | 5/2007 | Okada |
| 2007/0173310 | A1 | 7/2007 | Walker et al. |
| 2007/0281778 | A1 | 12/2007 | Bigelow, Jr. et al. |
| 2007/0287521 | A1 | 12/2007 | Glavich et al. |
| 2008/0113760 | A1 | 5/2008 | Baerlocher |
| 2008/0113761 | A1 | 5/2008 | Belger et al. |
| 2008/0113779 | A1 | 5/2008 | Cregan |
| 2008/0139296 | A1 | 6/2008 | Baerlocher et al. |
| 2008/0139298 | A1 | 6/2008 | Rodgers et al. |
| 2008/0153584 | A1 | 6/2008 | Cuddy et al. |
| 2008/0200232 | A1 | 8/2008 | Baerlocher et al. |
| 2008/0200237 | A1 | 8/2008 | Cuddy et al. |
| 2008/0207298 | A1 | 8/2008 | Marks et al. |
| 2008/0220851 | A1 | 9/2008 | Glavich et al. |

FOREIGN PATENT DOCUMENTS

| | | |
|---|---|---|
| EP | 0 874 337 | 10/1998 |
| EP | 0 926 645 | 6/1999 |
| EP | 1 513 114 | 3/2005 |
| EP | 1 513 117 | 3/2005 |
| EP | 1 783 707 | 5/2007 |
| EP | 1 870 861 | 12/2007 |
| GB | 970806 | 9/1964 |
| GB | 2 101 380 | 1/1983 |
| GB | 2 117 952 | 10/1983 |
| GB | 2 137 392 | 10/1984 |
| GB | 2 262 642 | 6/1993 |
| GB | 2 322 217 | 8/1998 |
| GB | 2 387 950 | 10/2003 |
| WO | WO 97/27570 | 7/1997 |
| WO | WO 97/32285 | 9/1997 |
| WO | WO 99/10849 | 3/1999 |
| WO | WO 00/32286 | 6/2000 |
| WO | WO 01/26019 | 4/2001 |
| WO | WO 02/099760 | 12/2002 |
| WO | WO 2004/025584 | 3/2004 |
| WO | WO 2005/083599 | 9/2005 |
| WO | WO 2006/017431 | 2/2006 |
| WO | WO 2006/077383 | 7/2006 |

OTHER PUBLICATIONS

50 Lions Advertisement, written by Aristocrat, published in 2004.
$1,000,000 Pyramid Video Slots Advertisement, written by IGT, published in 2003.
Addams Family—Cousin It Advertisement, written by IGT, published in 2002.
Addams Family—Cousin It's Good Hair Day Article, written by Strictly Slots, published in Apr. 2002.
Asian Princess Article, Aristocrat Technologies, written by Strictly Slots, published in Mar. 2005.
Austin Powers Groooovy, Baby Article, written by Strictly Slots, published in Apr. 2002.
Austin Powers Poker and Flex Play Poker Advertisement, written by IGT, published in 2001.
Austin Powers Time Portal Article, written by Strictly Slots, published in Jun. 2002.
Aztec Temple Multiway Enhanced Video Slots Advertisement, written by IGT, published in 2005.
Beetlemania Article, written by Strictly Slots, published in Dec. 2001.
Benny Big Game Advertisement, written by IGT, published in 2003.
Bonus Games Advertisement, written by IGT, published in 1999.
Bumble Bugs Advertisement, written by Aristocrat, published in Jan. 1997.
Catch a Wave Article, written by IGT, published in Dec. 2000.
Catch a Wave Advertisement, written by IGT, published in 2001.
Cheesy Money Advertisement, written by Atronic Casino Technology, Ltd., published in Dec. 2000.
Cleopatra Article, written by Strictly Slots, published in Dec. 2000.
Cleopatra Article, written by Strictly Slots, published in Sep. 2002.
Cleopatra Slots Advertisement, written by IGT, published in 2002.
Cleopatra Slots Advertisement, written by IGT, published in 2003.
Cleopatra Slots—5 Reel/ 9 Line Advertisement, written by IGT, published in 2004.
Corrida De Toros Advertisement, written by Aristocrat, published prior to Aug. 30, 2007.
Cuckoo Advertisement, written by Aristocrat, published Feb. 1998.
Dam Lumberjack Beavers Enhanced Video Slots Advertisement, written by IGT, published in 2004.
Dancing Spirit Advertisement, written by Atronic Casino Technology, Ltd., published in 2004.
The Dating Game Article, written by Strictly Slots, published in Aug. 2004.
Deep Blue Dollar$ Article, written by Strictly Slots, published in Jun. 2004.
Double Diamond Pennies Advertisement, written by IGT, published in 2004.
Double Diamond Run Advertisement, written by IGT, published prior to Aug. 30, 2007.
Double Diamond Run Slots Advertisement, written by IGT, published in 2002.
Double Diamond Run Slots Advertisement, written by IGT, published in 2004.
Double Diamond Slots Advertisement, written by IGT, published in 2003.
Double Down Stud Poker—Triple Play/Five Play/Ten Play Advertisement, written by IGT, published in 2004.
Draw Poker (Five Play, Triple Play and Ten Play) Advertisement, written by IGT, published in 2003.
Dream Maker Advertisement, written by Atronic Casino Technology, Ltd., published in 2002.
Dream Maker Advertisement, written by Atronic Casino Technology, Ltd., published in 2003.
Fifty Play Poker Advertisement, written by IGT, published in 2001.
Fifty Play Poker Article [online] [retrieved on Mar. 21, 2001]. Retrieved from the Internet at <URL: http://www.igt.com>.
Flex Play Poker Advertisement, written by IGT, published in 2001.
Frog Prince Advertisement, written by IGT, published in 2001.
Frog Prince Article, written by Strictly Slots, published in Jun. 2001.
Game King Series Ten Play Draw Poker Advertisement, written by IGT, published in 2001.
Game King Series Triple Play—Five Play Draw Poker Advertisement, written by IGT, published in 2001.
Golden Archer Advertisement, written by Aristocrat, published in 2006.
Hexbreaker Video Slots Advertisement, written by IGT, published in 2003.
Hot Flashes Enhanced Video Slots Advertisement, written by IGT, published in 2005.
Inca Sun Article, written by Strictly Slots, published in Apr. 2002.
International Search Report for PCT/US2007/077681, issued Mar. 19, 2009.
International Search Report for corresponding Macau Patent Application 1000560 (494), issued Apr. 21, 2009.
It's a Blast Video Slots Advertisement, written by IGT, published in 2004.
Jackpot Deluxe Article, written by Aristocrat, published in Jan. 2007.
Jackpot Party Brochures and Articles, written by WMS Gaming, Inc., published in 1998.
Jazzy Jackpots Advertisement, written by Atronic Casino Technology, Ltd., published in 2000.
Jazzy Jackpots Article, written by Strictly Slots, published in Apr. 2001.
Jumping Jackpots Advertisement, written by written by Atronic Casino Technology, Ltd., published in 2002.
Kenny Rogers the Gambler Video Slots Advertisement, written by IGT, published in 2003.
King of the Nile Article, written by Strictly Slots, published in Sep. 2003.
Kismet Advertisement, written by Atronic Casio Technology, Ltd., published in 2004.
Leopard Claw Slots Advertisement, written by IGT, published in 2004.
Li'l Lucy Advertisement, written by Aristocrat, published prior to Aug. 30, 2007.
Lil' Lucy Article, written by Strictly Slots, published in Nov. 2003.
Little Devil Advertisement, written by IGT, published in 1998.

Mata Hari Slots Advertisement, written by IGT, published in 2002.
Money Honey Advertisement, written by Aristocrat, published prior to Aug. 30, 2007.
Money Honey Advertisement, written by Aristocrat, published in 2004.
Money in the Bank Article, written by Strictly Slots, published Jun. 2001.
Mystical Mermaid Advertisement, written by IGT, published in 2004.
Pharaoh's Fortune Video Slots Advertisement, written by IGT, published in 2004.
Pharaoh's Gold Video Slots a Advertisement, written by IGT, published prior to Aug. 30, 2007.
Pompeii Advertisement, written by Aristocrat, published in Dec. 2002.
Pompeii Advertisement, written by Aristocrat, published in Feb. 2003.
Rodney Dangerfield's Reel Respect Article, written by Strictly Slots, published in Feb. 2004.
The Sign of Zodiac Advertisement, written by Atronic Casino Technology, Ltd., published in 2003.
The Sign of Zodiac Article, written by Strictly Slots, published in Aug. 2003.
Slotopoly Advertisement, written by IGT, published in 1998.
Slots 2003 Article, written by Melissa Raimondi, published in Jan. 2003.
SnapShot Article, written by Strictly Slots, published in Aug. 2003.
Spin Til You Win Game Description, written by IGT, published in 1996.
Star Wars Video Slots Advertisement, written by IGT, published prior to Aug. 30, 2007.
Sweet Liberty Article, written by Strictly Slots, published in Mar. 2002.
Super Spin Sizzling 7 Slots Advertisement, written by IGT, published in 2002.
Super Stars Spin Slots Advertisement, written by IGT, published in 2003.
Top Dollar Advertisement, written by IGT, published in 1998.
Top Dollar Lucky Roll Slots Advertisement, written by IGT, published in 2002.
Totally Puzzled Video Slots Advertisement, written by IGT, published in 2004.
Triple Bucks Advertisement, written by IGT, published in 1999.
Triple Play/Five Play/Ten Play Draw Poker Advertisement, written by IGT, published prior to Aug. 30, 2007.
Triple Sevens Advertisement, written by Barcrest, published prior to Aug. 30, 2007.
Video Star Advertisement, written by Barcrest, published prior to Aug. 30, 2007.
Viva Las Vegas Video Slots Advertisement, written by IGT, published in 2006.
Wheel of Fortune Video Advertisement, written by IGT, published in 1999.
White Nights Video Slots Featuring the Money Bags Bonus Advertisement, written by IGT, published prior to Aug. 30, 2007.
Wild Bear Salmon Run Advertisement, written by IGT, published in 2003.
Wild Taxi Advertisement, written by IGT, published in 2003.
Winning Streak Advertisement, written by Aristocrat, published in Feb. 1994.
Wolf Run Video Slots Advertisement, written by IGT, published in 2006.

GAMING SYSTEM HAVING A PLURALITY OF SIMULTANEOUSLY PLAYED WAGERING GAMES THAT MAY TRIGGER A PLURALITY OF FREE GAMES WHICH MAY BE PLAYED SIMULTANEOUSLY WITH THE WAGERING GAMES

PRIORITY CLAIM

This application is a continuation of, claims priority to and the benefit of U.S. patent application Ser. No. 11/847,995, filed on Aug. 30, 2007, which is a non-provisional of, claims priority to and the benefit of U.S. Provisional Patent Application Ser. No. 60/825,038, filed Sep. 8, 2006, the entire contents of each of which are incorporated by reference herein.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (i.e., the higher the wager, the higher the award). Symbols or symbol combinations which are less likely to occur usually provide higher awards.

Secondary or bonus games are also known in gaming machines. These secondary or bonus games usually provide an additional award to the player. Such bonus awards are factored or calculated in when determining the overall paytable for the gaming machine. Secondary or bonus games usually do not require an additional wager by the player to be activated. Secondary or bonus games are often activated or triggered upon an occurrence of a designated triggering symbol or triggering symbol combination in the primary or base game of the gaming machine. For instance, a bonus symbol occurring on a payline on the third reel of a three reel slot machine may trigger the secondary bonus game on that gaming device. Part of the enjoyment and excitement of playing certain gaming machines is the occurrence or triggering of the secondary or bonus game. In other words, obtaining a bonus event and a bonus award in the bonus event is part of the enjoyment and excitement for players.

It is also exciting for players to win free games or free spins. Certain gaming machines provide players with a designated number of free spins upon a triggering event. When a player wins a plurality of free spins, there is a time period where the player is playing the free spins and is not placing any wagers.

SUMMARY

The present disclosure provides a gaming machine or gaming system having a plurality of games which each can be provided as a wagering game or as a free game. The gaming machine or gaming system enables the player to wager on and simultaneously play the plurality of the games. If any free games are won by the player during the played games, the gaming machine or gaming system enables the player to wager on one or more of the games and to play one or more of the games as a wagering game, while simultaneously playing one or more of the games as a free game.

In one embodiment, the gaming machine includes a plurality of wagering games and a plurality of free games. These wagering games and free games may be the same games with the only difference being that the wagering games require a wager to initiate the game wherein the free games may be played after the gaming machine provides them to the player. Additionally, one or more of the wagering games may be different games and one or more of the free games may be different games. In one embodiment, a plurality or each of the wagering games each have or are each associated with a triggering event or a free game triggering event. In one embodiment, each free game triggering event is associated with a designated number of free games or one or more designated free games.

In a first play of the gaming machine, the gaming machine displays a plurality of the wagering games to a player. The gaming machine enables the player to wager on and to simultaneously play one, a plurality or all of the displayed wagering games. The gaming machine generates game outcomes for all of the played wagering games. The gaming machine determines if there is an occurrence of any winning game outcomes such as any winning symbols or winning symbol combinations for each played wagering game and provides the player an award for each winning game outcome. The gaming machine also determines if there is an occurrence of any free game triggering events associated with any of the played wagering games. If there is an occurrence of one of the free game triggering events, the gaming machine provides the player with the one or more free games associated with that triggering event. For instance, if the player plays three wagering games and a free game triggering event occurs in the play of the second game, the gaming machine provides the player a designated number of free plays of the second game.

In a second play of the gaming machine, the gaming machine enables the player to wager on one, a plurality or all of the wagering games and also to simultaneously play any provided free games. That is, in one embodiment, the gaming machine automatically provides any won free games to the player in the second play of the gaming machine and enables the player to wager on any of the other wagering games, such that the player simultaneously plays the provided free games and the wagered on wagering games.

In one embodiment, the free games are also associated with or include one or more free game triggering events. Each of the free game triggering events is associated with one or more free games. Upon an occurrence of a free game triggering event associated with any of played free games, the gaming machine provides the player with the designated free games associated with that generated free game triggering event. The gaming machine provides the player any awards associated with any of the generated game outcomes.

For example, in one embodiment, the games and thus the wagering games and the free games are slot games. The gaming machine displays 21 five-reel slot games to the player. Each of the slot games is associated with a free game triggering event. In this example, the free game triggering event for each of the wagering games is the generation of the symbol combination 7-7 on a payline in the five-reel slot game. In this example embodiment, each of the free games is triggered upon the same free game triggering event. The free triggering event for each of the free games is also the generation of the symbol combination 7-7. Upon the generation of the symbol combination 7-7 in one of the played wagering games or free games, the gaming machine provides the player a designated number of free slot games, such as five.

In this example, in a first play of the gaming machine, the gaming machine enables the player to select a number of wagering games to play and to place a wager for each of the plurality of wagering games. The player selects and plays all of the 21 wagering games. The gaming machine generates an outcome for each played wagering game. The gaming machine also determines if there is an occurrence of the free game triggering event in any of the wagering games. The player achieves an occurrence of the free game triggering event, the symbol combination 7-7, in 3 of the 21 wagering games. Therefore, the gaming machine awards the player the 15 free slot games, five for each free game triggering event. The gaming machine provides the player any awards associated with any of the other winning outcomes in the wagering games.

In this example, in a second play of the gaming machine, the gaming machine automatically provides the player one play of the free game on the game that triggered the free game. In one embodiment, the free game can only be played on the winning game. That is, if a player wins five free games from a slot game displayed in the upper right hand corner of a display device of a gaming device, the free game is played on that particular slot game. Therefore, if a player wins multiple games, the player can only play the free games in more than one play of the gaming machine because the player may only play one free game at a time on the won game increasing the amount of time a player is playing free games. In this example, in the second play of the gaming machine, the player will play the 3 of the 15 free games (i.e., one for each of the wagering games on which the free game triggering event occurred). Additionally, before the initiation of the provided free games, the gaming machine enables the player to wager on a plurality of the wagering games. In one embodiment, the player has the opportunity to win more free games from any played games (including free games and wagering games). This process of playing free games with the possibility of simultaneously playing and wagering on wagering games continues until the player does not have any free games or has no free games remaining. Thereafter, the player can continue to play wagering games.

It should be appreciated that the gaming machine may enable the player to play the free games in any suitable manner. The gaming machine may automatically play a plurality or all of the free games in the next play of the gaming machine. In another embodiment, the gaming machine enables the player to determine how many free games to simultaneously play. That is, when a player is provided free games, the player determines how many free games they want to play in a next play of the game.

In another embodiment, the gaming machine or gaming system enables the player to simultaneously play all of the won free games. For example, the maximum number of games the player may simultaneously play on a gaming machine or system is 21. If the player wins four free games in a first round of game play, the gaming machine enables the player to play the four free games and to wager on 17 wagering games in a second round of game play.

In another embodiment, the gaming machine includes a plurality of different free games and enables the player to select the free game to play. In one embodiment, if a player wins multiple free games, the gaming machine enables the player to select a single type of game for the multiple free games and play all of the free games as the selected type of game. In another embodiment, if a player wins multiple free games, the gaming machine enables the player to select multiple games for the multiple free games. That is, the player selects the type of game for each free game provided to the player.

In another embodiment, the gaming machine enables the player to pick an overall number of games to play. The gaming machine only requires the player's wager amount to cover the difference between the overall number of games minus any available free games. For example, a player has three free games and selects 9 games to play at 3 credits a game. To initiate the game, the player only needs to place a wager of 18 ((9−3)×3) credits to play the 9 games. The gaming machine automatically utilizes the free games.

It should be appreciated that the games provided to the player may be the same games or may be different games. The games may be any suitable game, such as, but not limited to, slots, poker, bunco, checkers, blackjack, roulette, keno, bingo, craps and any combination of these or any other suitable random game which results in awards.

In one embodiment, the gaming machine includes a plurality of different games and the free game associated with the free game triggering event is the same game as the triggering wagering game. That is, any free games won or triggered by the wagering games result in that same free game. For example, if the player won free games from a blackjack game, the free games provided to the player are blackjack games.

One, a plurality, or all of the wagering and/or the free games have or are associated with a free game triggering event. In various embodiments, one, a plurality or all of the wagering games and/or free games are each associated with a plurality of free game triggering events.

The gaming machine may determine the number of free games to provide a player for the occurrence of each free game triggering event in any suitable manner. In one embodiment, each free game triggering event is associated with a number of games. In another embodiment, the gaming machine determines the number of free games to provide to a player based on the amount the player wagered on the triggering wagering game.

In one embodiment, the free games include an advantage for the player. That is, in one embodiment, free games provide the player with a benefit or characteristic that is not included in the wagering games. The free games may include any suitable advantage over the wagering games. The advantage provides incentive for the player to attempt to win the free games. For example, the free games may be associated with a higher paytable than the wagering games and therefore provide the opportunity for the player to win higher awards from the free games than the wagering games.

It is therefore an advantage of the gaming system to enable a player to simultaneously play multiple games.

It is therefore an advantage of the gaming system to enable a player to win one or more free games upon a free game triggering event in one of a plurality of simultaneously played the wagering games.

It is therefore another advantage of the gaming system to enable the player to play one or more free games and one or more wagering games simultaneously.

Other objects, features and advantages of the disclosure will be apparent from the following detailed disclosure, taken in conjunction with the accompanying sheets of drawings, wherein like numerals refer to like parts, elements, components, steps and processes.

DETAILED DESCRIPTION OF THE INVENTION

The present disclosure may be implemented in various configurations for gaming machines, gaming devices or gaming systems, including but not limited to: (1) a dedicated gaming machine, gaming device, or gaming system wherein the computerized instructions for controlling any games (which are provided by the gaming machine or gaming device) are provided with the gaming machine or gaming device prior to delivery to a gaming establishment; and (2) a changeable gaming machine, gaming device, or gaming system where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by at least one central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
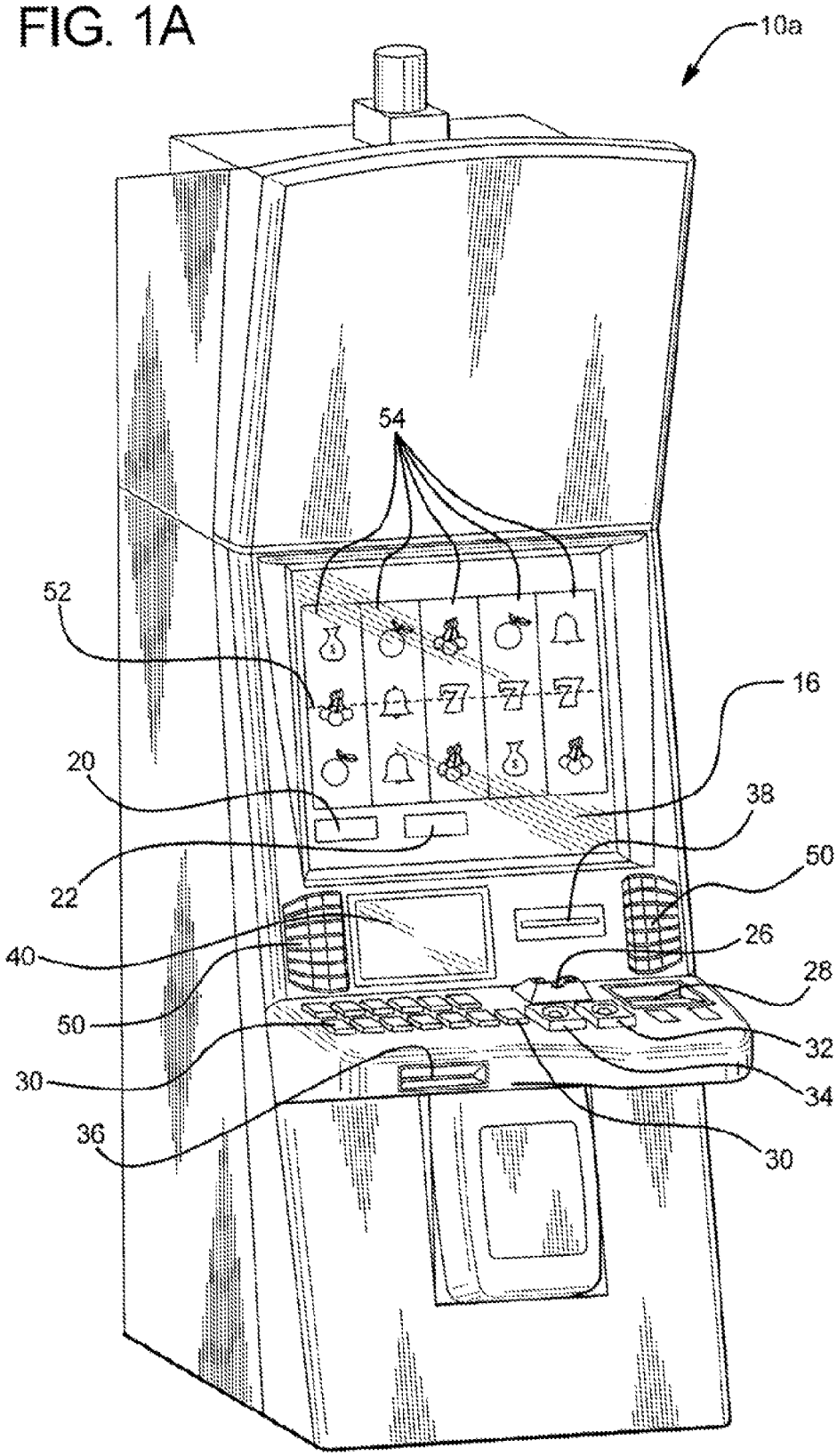
FIGS. 1A and 1B are perspective views of alternative embodiments of the gaming device of the present disclosure.
Figure 1B:
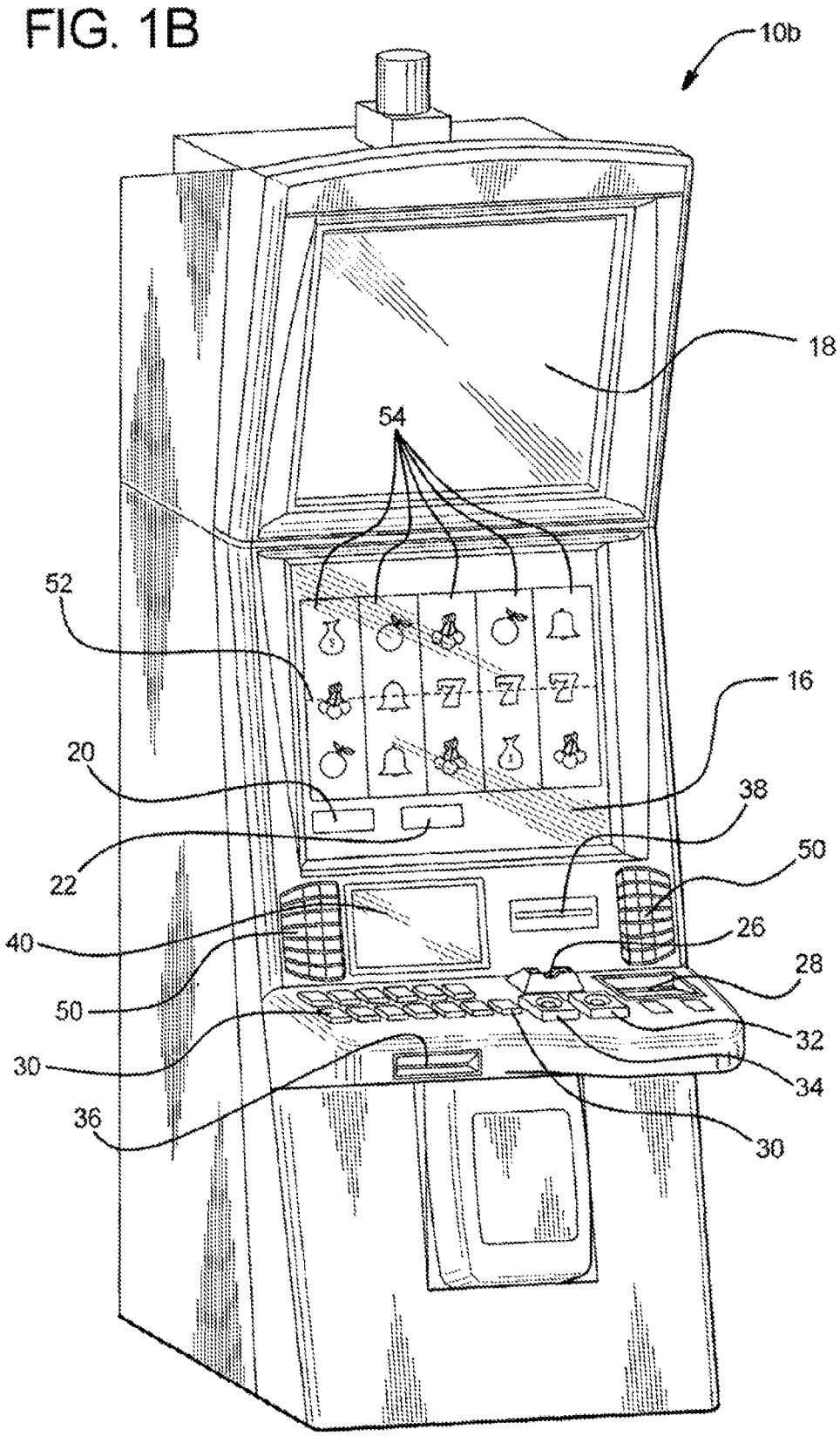

Referring now to the drawings, two example alternative embodiments of the gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
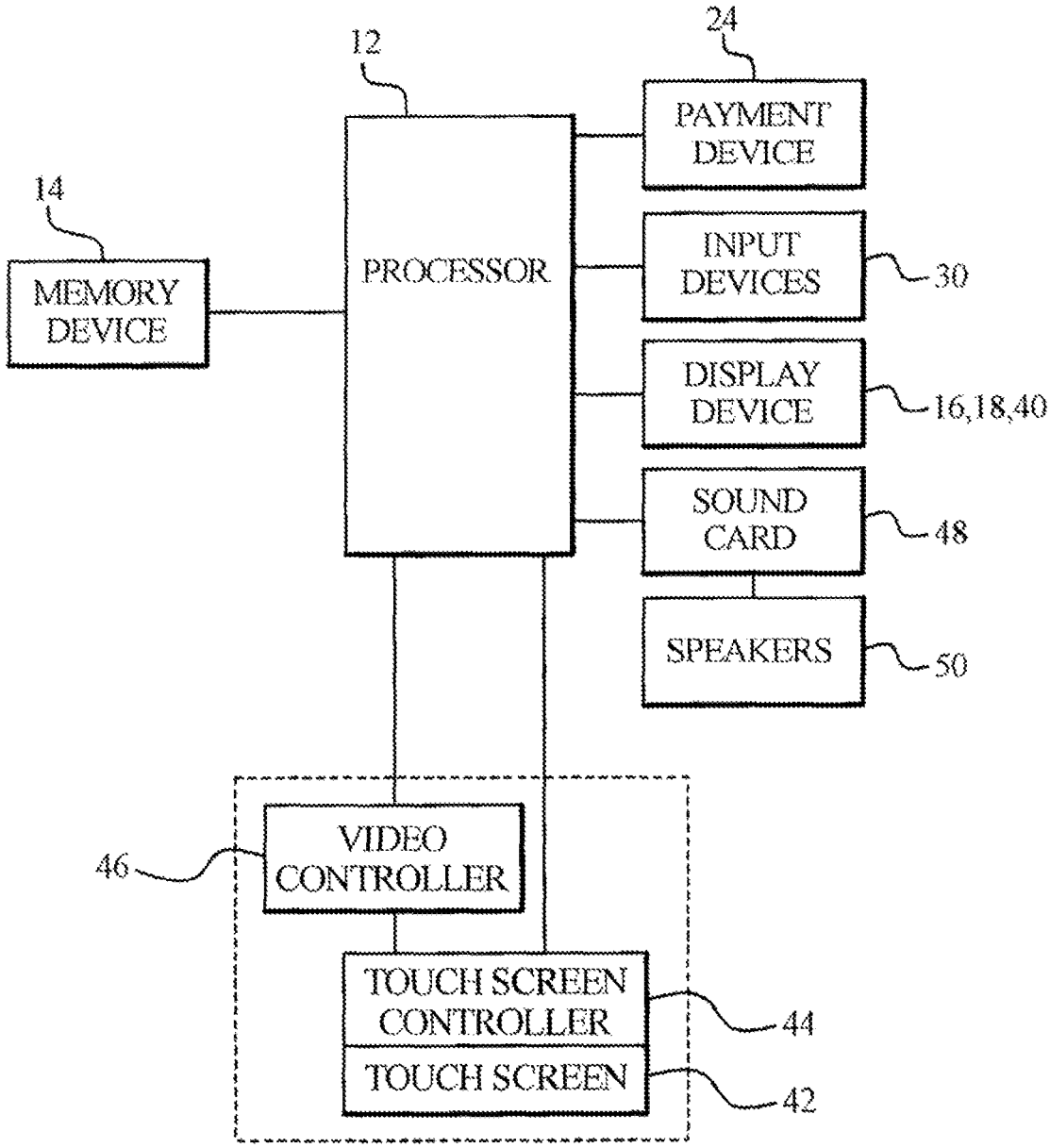
FIG. 2A is a schematic block diagram of the electronic configuration of one embodiment of the gaming device of the present disclosure.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, paytable data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance or the equivalent. In one embodiment, the gaming device includes a bet display 22 which displays a player's amount wagered. In one embodiment, as described in more detail below, the gaming device includes a player tracking display 40 which displays information regarding a player's playing tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card may be implemented in accordance with the gaming device disclosed herein.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a conventional touch-screen button panel.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary or base game. The gaming machine or device or system may include some or all of the features of conventional gaming machines or devices. The primary game, base game whether played as wagering games or free games may comprise any suitable reel-type game, card game, cascading or falling symbol game, number game or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented and played as wagering games and free games.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, display the plurality of simulated video reels 54. Each reel 54 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device with wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

In one embodiment, a base or primary game, playable as a wagering game and/or free game, may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game, playable as a wagering game and/or free game, may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, playable as a wagering game and/or free game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game, playable as a wagering game and/or free game, or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition may be by exceeding a certain amount of game play (such as number of games, number of credits, amount of time), or reaching a specified number of points earned during game play.

In another embodiment, the gaming device processor 12 or central server 56 randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
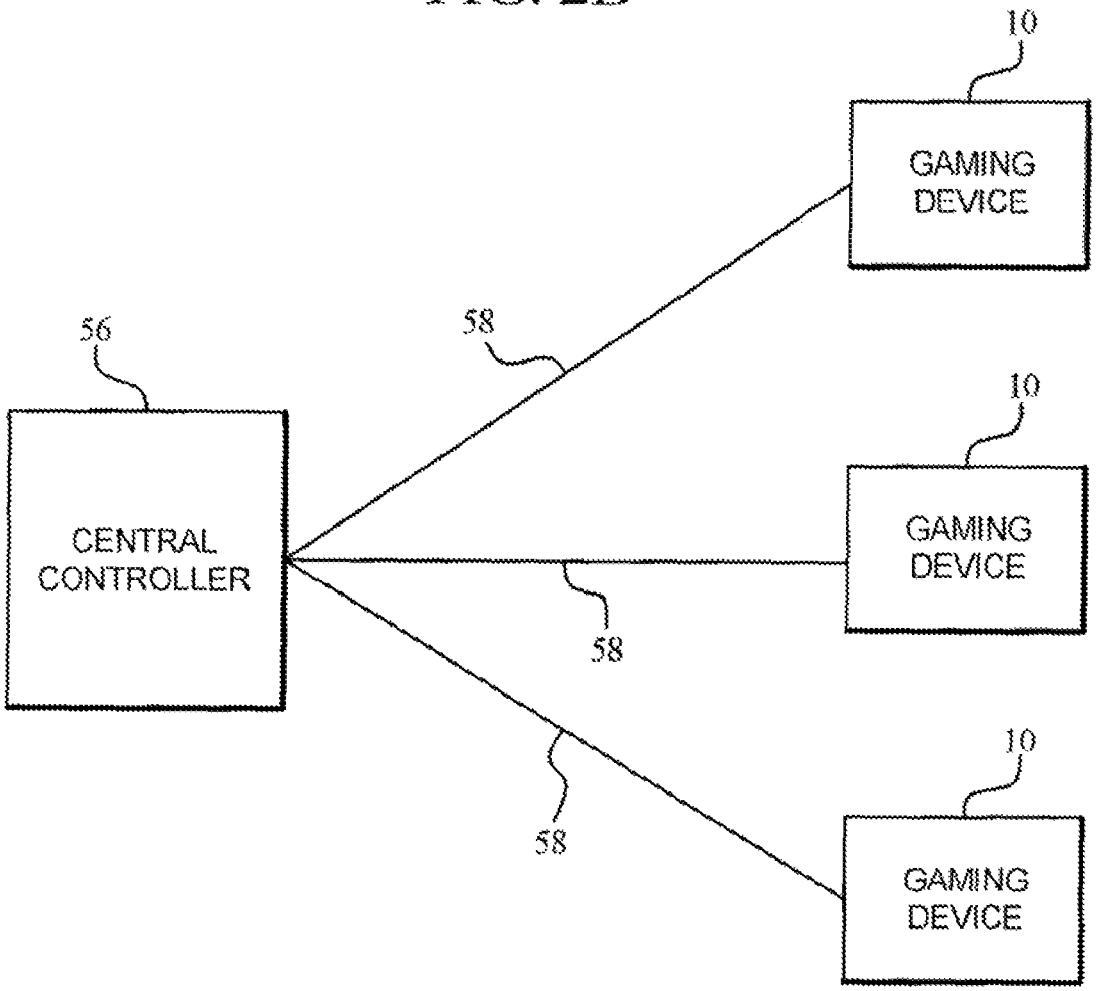
FIG. 2B is a schematic block diagram illustrating a plurality of gaming terminals in communication with a central controller.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo, keno or lottery game. In this embodiment, each individual gaming device utilizes one or more bingo, keno or lottery games to determine the predetermined game outcome value provided to the player for the interactive game played at that gaming device. In one embodiment, the bingo, keno or lottery game is displayed to the player. In another embodiment, the bingo, keno or lottery game is not displayed to the player, but the results of the bingo, keno or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any players gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Wagering Games and Free Games

Figure 3:
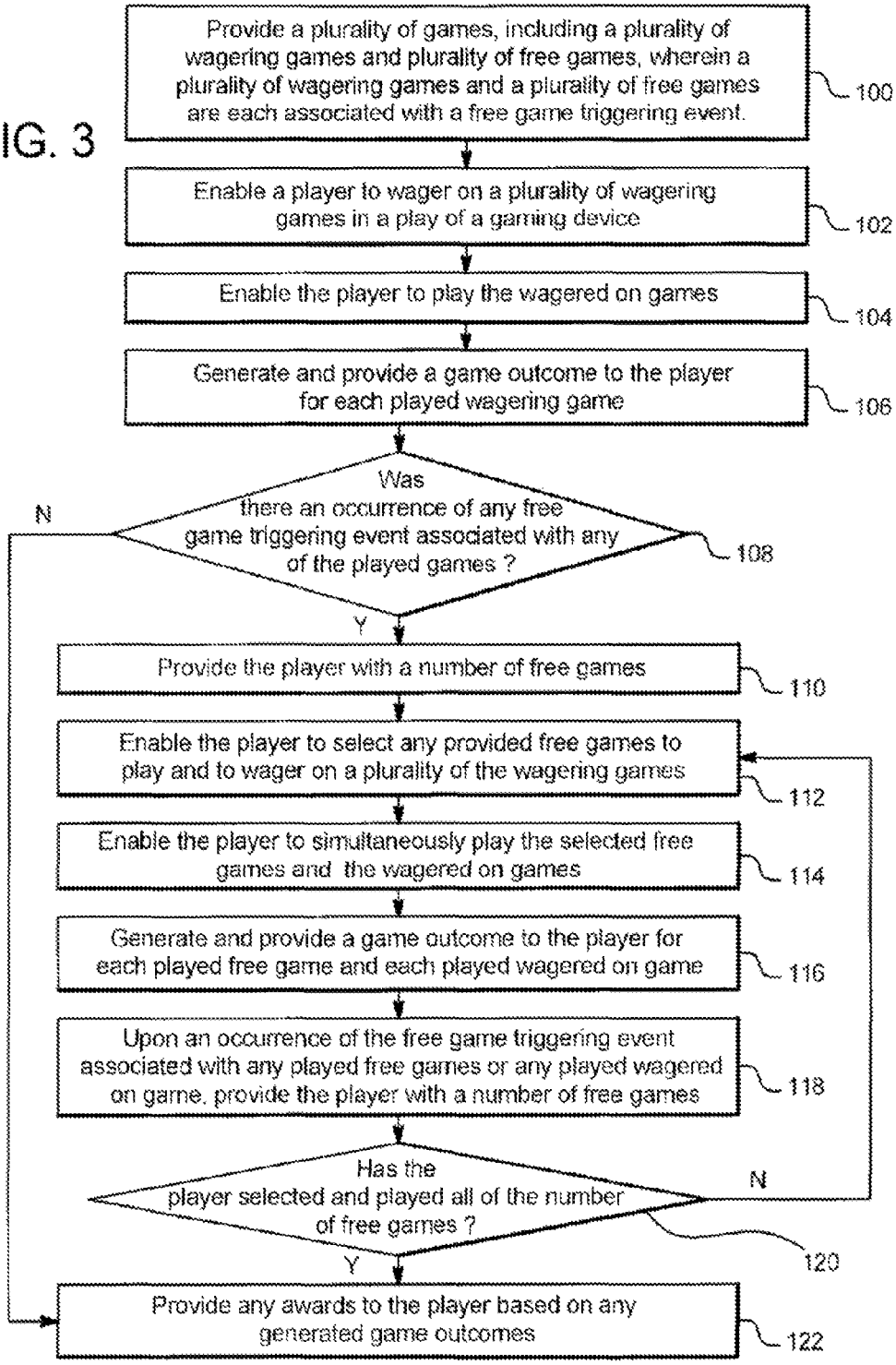
FIG. 3 is a flow chart of the method of one embodiment disclosed herein, illustrating that a player may win free games from wagering games and then simultaneously play the free games and wagering games.

FIG. 3 is a flow chart illustrating one method of the present disclosure. The gaming system has or provides a plurality of games as illustrated in block 100. The games include a plurality of wagering games and a plurality of free games as illustrated in block 100. A plurality of the wagering games and a plurality of free games are each associated with a free game triggering event as illustrated in block 100. In one embodiment, each free game triggering event is associated with a free game. The gaming system enables a player to wager on a plurality of wagering games in a play of the gaming system as illustrated in block 102. The gaming system enables the player to play the wagered on wagering games as illustrated in block 104. The gaming system generates and provides a game outcome to the player for each played wagering game as illustrated in block 106. The gaming system determines if there is an occurrence of any free game triggering event associated with any of the played wagering games as illustrated in diamond 108. If there is not an occurrence of the free game triggering event, the gaming system provides any awards to the player based on any generated game outcomes as illustrated in block 122.

If there is an occurrence of a free game triggering event, the gaming system provides the player with a number of free games as illustrated in block 110 and enables the player to wager on a plurality of the wagering games as illustrated in block 112. The gaming system enables the player to simultaneously play the provided free games and the wagered on wagering games as illustrated in block 114. The gaming system generates and provides a game outcome to the player for each played free game and each played wagering game as illustrated in block 116. Upon an occurrence of the free game triggering event associated with any played free games or any played wagering games, the gaming system provides the player with the associated free game as illustrated in block 118. The gaming system determines if the player has played all of the provided free games as illustrated in block 120. If the player has played all of the provided free games, the gaming system provides any awards to the player based on any generated game outcomes. If the player has played all of the provided free games, the gaming system again enables the player to wager on wagering games and play the wagered on wagering games simultaneously with the free games as illustrated in block 122.

Figure 4A:
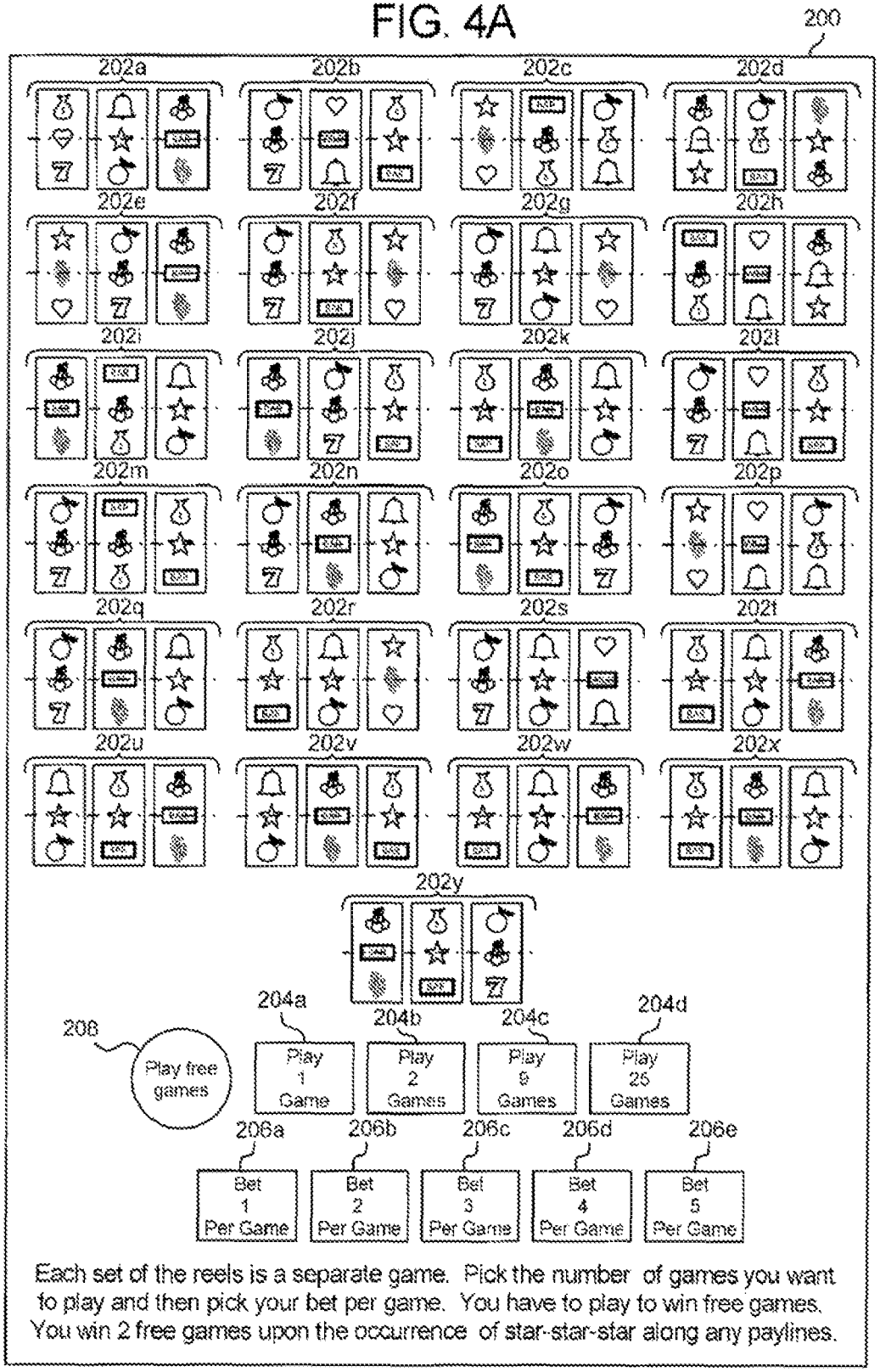
FIGS. 4A, 4B, 4C, 4D, 4E, 4F, 4G, 4H, 4I, 4J, 4K, 4L, 4M, 4N, 4O, and 4P are front views of a display device of one embodiment disclosed herein, illustrating a gaming device enabling a player to wager on a plurality of games and to simultaneously play a plurality of free games and wagering games.

Referring now to FIGS. 4A, 4B, 4C, 4D, 4E, 4F, 4G, 4H, 4I, 4J, 4K, 4L, 4M, 4N, 4O, and 4P in one embodiment, the gaming system includes a plurality of games and all of the games are the same. In the illustrated embodiment, all of the wagering games are slot games. In this embodiment, each slot game includes a free game triggering event that is associated with two free slot games. In one embodiment, the free game triggering event for each of the games is the symbol combination star-star-star. As illustrated in FIG. 4A, in one embodiment, the display device of a gaming machine displays a plurality of three-reel slot games 202*a*, 202*b*, 202*c*, 202*d*, 202*e*, 202*f*, 202*g*, 202*h*, 202*i*, 202*j*, 202*k*, 202*l*, 202*m*, 202*n*, 202*o*, 202*p*, 202*q*, 202*r*, 202*s*, 202*t*, 202*u*, 202*v*, 202*w*, and 202*y*. In another embodiment, the display device of a player station and/or the individual display segments of a shared central display display the games such that they are viewable to multiple players. These display segments may be individual display devices or segments of a single display device that each display a single game. In one embodiment, the display device of the gaming device or of the individual gaming stations includes a touch screen that includes touch screen buttons that enable the player to make game inputs. The display device includes touch screen buttons that enable the player to make an input to play 1 game 204*a*, 2 games 204*b*, 9 games 204*c*, or 25 204*d* games. The display device includes a touch screen button that enables the player to play free games 208. Additionally, the display device includes touch screen buttons that enable the player to bet 1 credit per game 204*a*, bet 2 credits per game 206*b*, bet 3 credits per game 206*c*, bet 16 credits per game 206*d*, or bet 5 credits per game 206*e*.

Each set of reels is a separate independent game. The display device instructs the player to pick a number of games and then pick a bet per game. In the illustrated embodiment, if the gaming system generates the combination of star-star-star along one of the paylines, the player wins two free slot games. However, it should be appreciated that any suitable triggering event may trigger the free games.

Figure 4B:
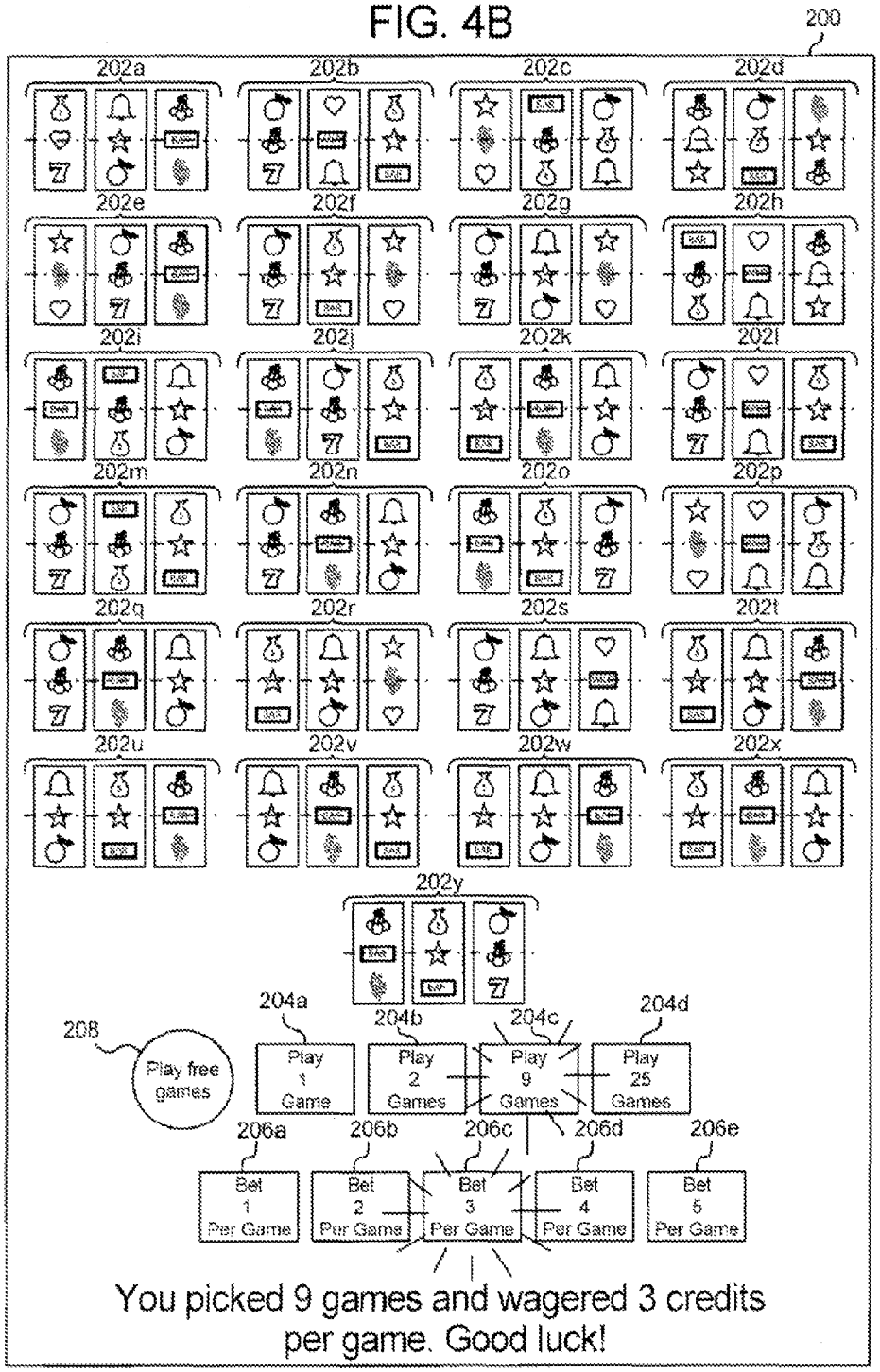

As illustrated in FIG. 4B, a player makes an input to play 9 of the 25 games and to bet 3 credits per played game. In one embodiment, upon initiation of the games, the display device zooms in on the games being played. That is, the gaming system only displays the selected games and displays the selected games larger than they were displayed when all of the games were displayed on the display device. In another embodiment, the central display displays are, a plurality of each of the games individually on the central display.

Figure 4C:
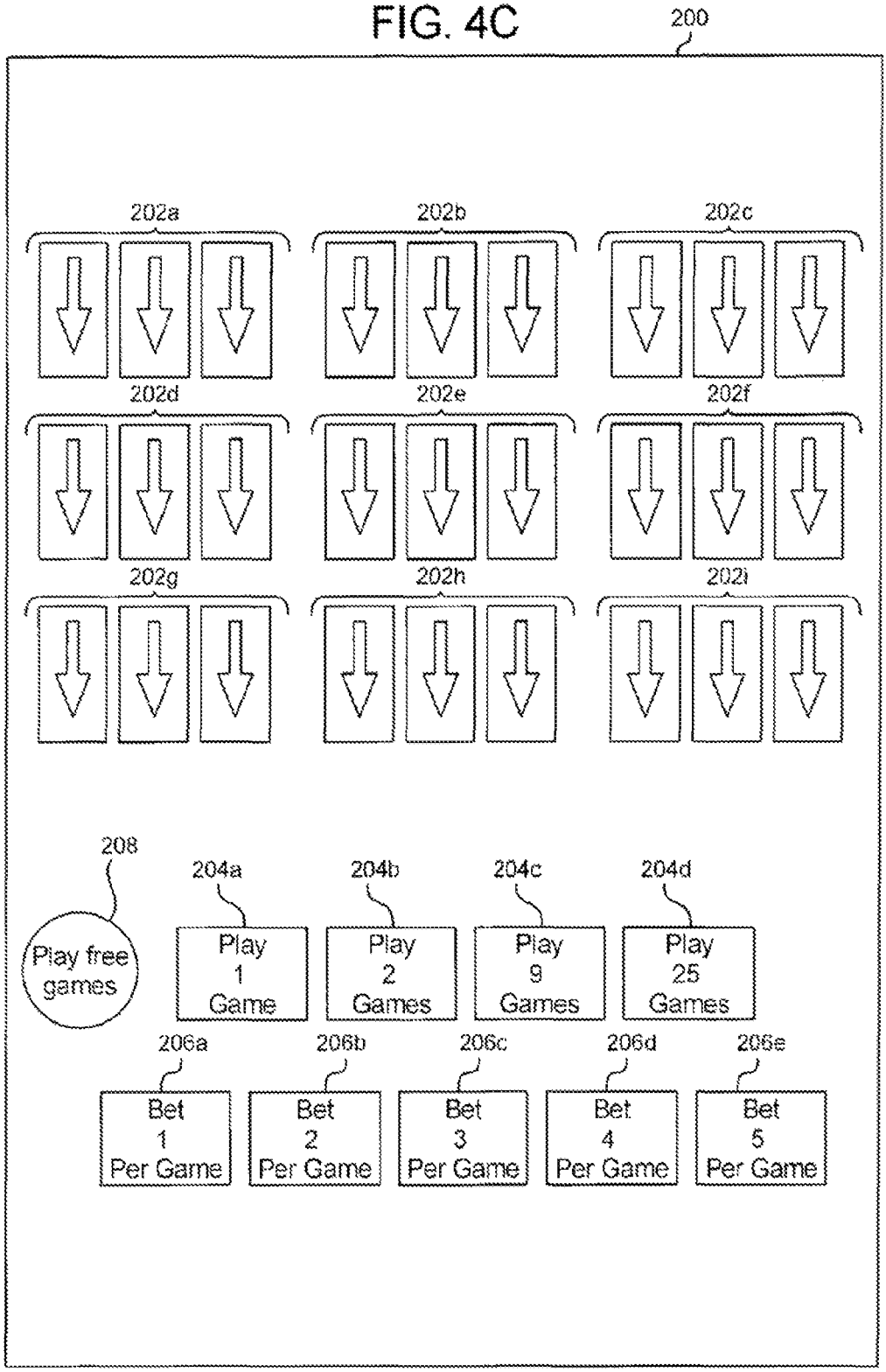

As illustrated in FIG. 4C, the display device displays each of the reels 202*a*, 202*b*, 202*c*, 202*d*, 202*e*, 202*f*, 202*g*, 202*h*, and 202*i* of the selected slot games simultaneously spinning. It should be appreciated that the reels may spin in any suitable manner.

Figure 4D:
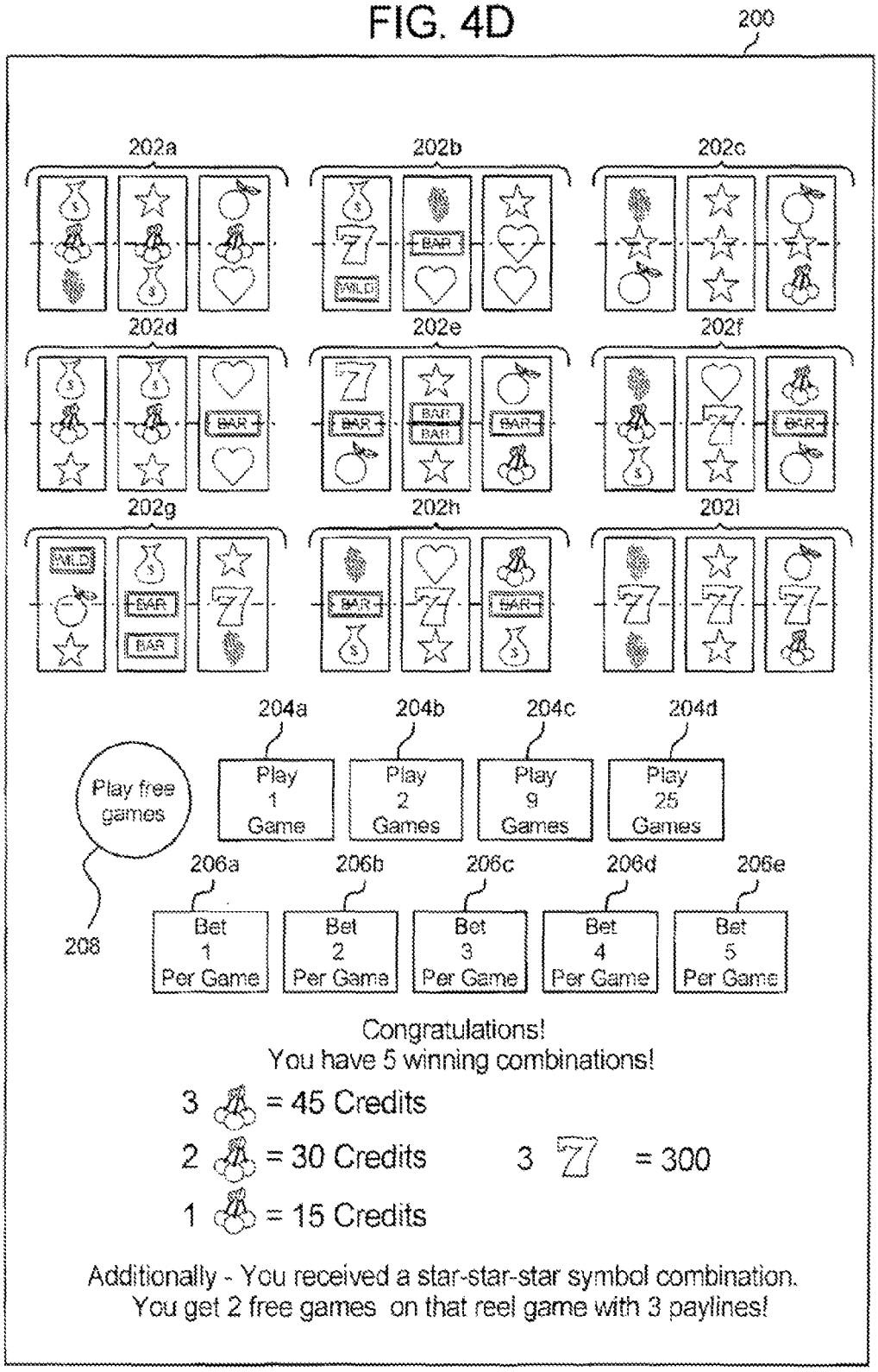

As illustrated in FIG. 4D, each of the slot games 202*a*, 202*b*, 202*c*, 202*d*, 202*e*, 202*f*, 202*g*, 202*h*, and 202*i* generates a plurality of symbols and produces a game result. As illustrated in FIG. 4D, the first set of reels generates three cherry symbols on the payline. In one embodiment, the scoring of this game is determined by a paytable and on the amount wagered. The three cherry symbols correspond to an award of 45 credits. Therefore, the gaming system provides the player an award of 45 credits as indicated on the display device. Cherry symbols were also generated in the fourth slot game and the sixth slot game which correspond to awards of 30 credits and 15 credits for the player. The last slot game generated three 7 symbols which is worth an award of 300 credits as indicated on the display device. Therefore, in monetary awards, the player wins 390 credits from the nine games played.

As illustrated by FIG. 4D, the third game or the third set of reels 202*c* generated the free game triggering event of three star symbols. Therefore, the player has won two free games.

In one embodiment, the free games provide one or more advantages to the player over the wagering games. That is, there is extra incentive to try to win free games because the free games are different in some way from the wagering games. In the illustrated embodiment, the player receives one payline for the wagering games and two paylines for the free games. That is, the player receives two additional paylines for the free games without wagering more. In the illustrated embodiment, the gaming system provides the player the same wager for each payline in the free game as the amount initially wagered on the payline in the wagering game. That is, if a player wagers five credits for the payline in the wagering game, any awards from the three paylines in the free game will be determined based on five credits wagered for each of the three paylines. This feature gives players incentive to wager more per payline because if the player wins free games, they will receive more chances to win via the more paylines based on the higher wager. That is, the player wagered only five credits in a wagering game but the free game is being played as a fifteen credit game.

Figure 4E:
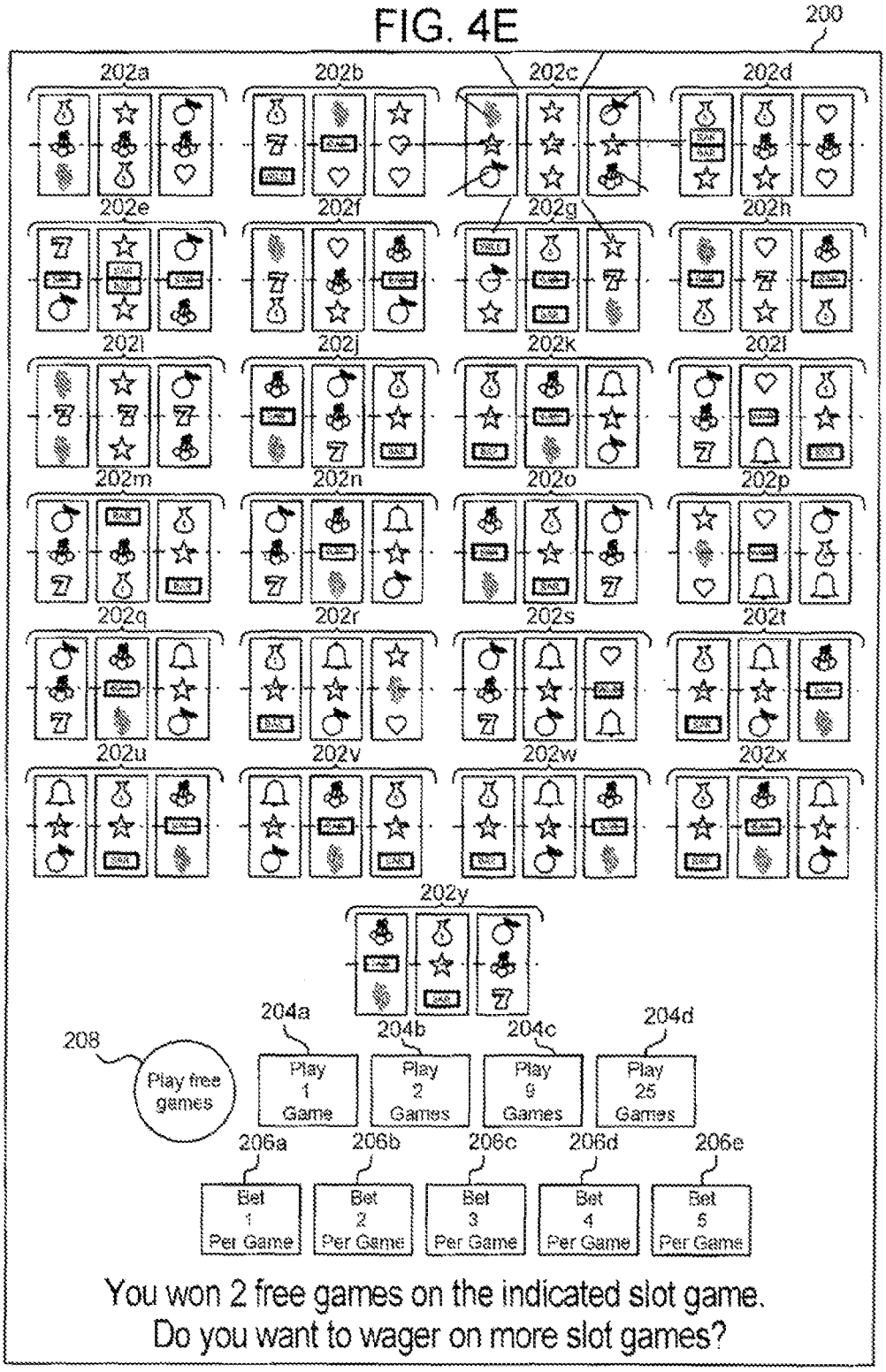

As illustrated in FIG. 4E, the gaming system communicates to the player that they won 2 free games on the indicated slot game that generated the free game triggering event. In the illustrated embodiment, the player may play the free game on the same game as the triggering game. That is, if the player won a free game on the fifth game, the free game must be played on the fifth game. Therefore, a player may only play one free game for each triggering game in a next play of the gaming system.

Figure 4F:
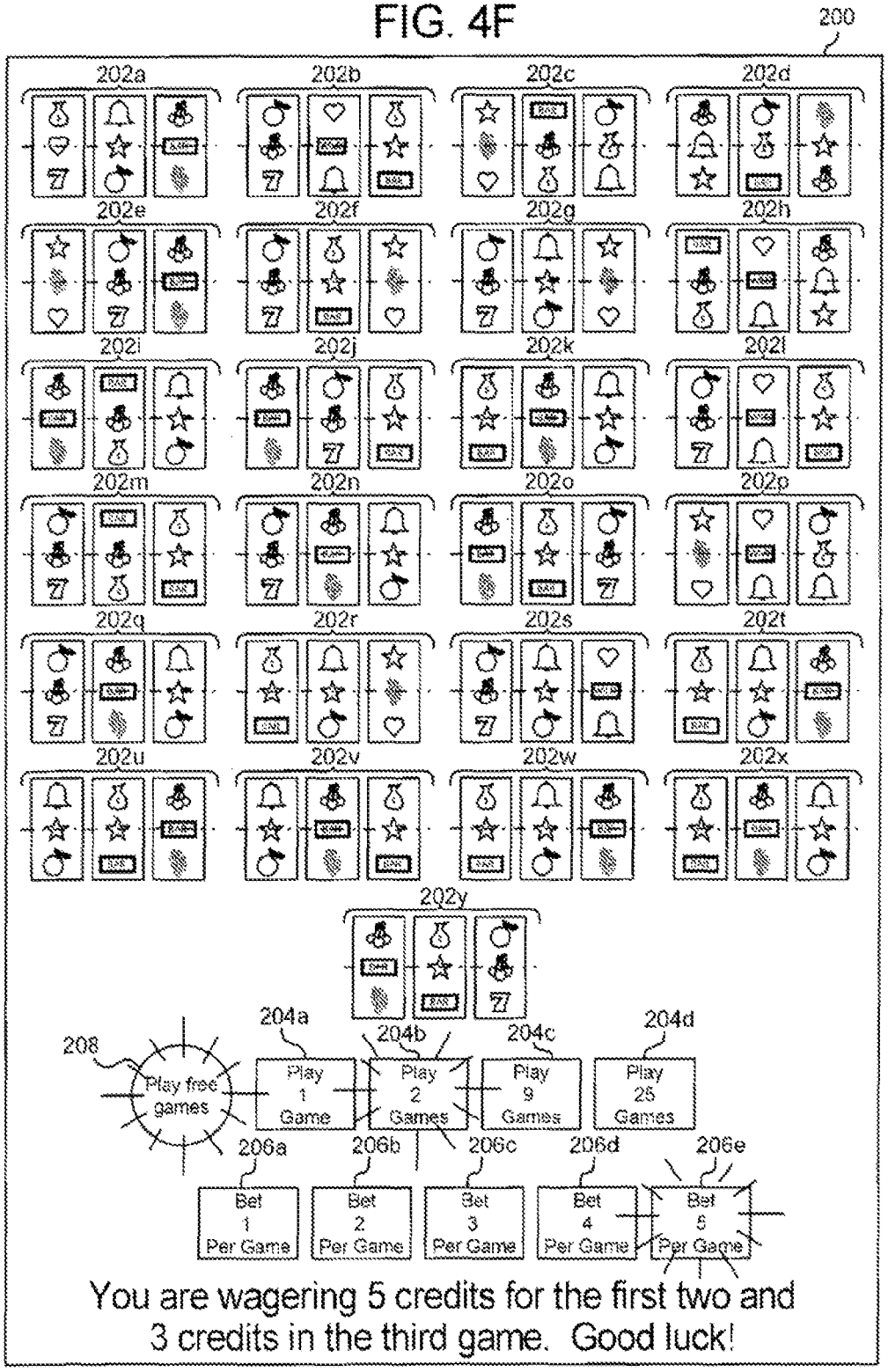

As indicated in FIG. 4F, the player chooses to play one free game. In one embodiment, any award provided for any free game is based on the initial wager from the triggering wagering game. As illustrated in FIG. 4F, the gaming system determines any awards from the free game based on the wager of three credits from the triggering wagering game. The player additionally makes an input to simultaneously play two wagering games. The player wagers five credits for each of these wagering games. That is, the player is simultaneously playing a single free game and two wagering games.

Figure 4G:
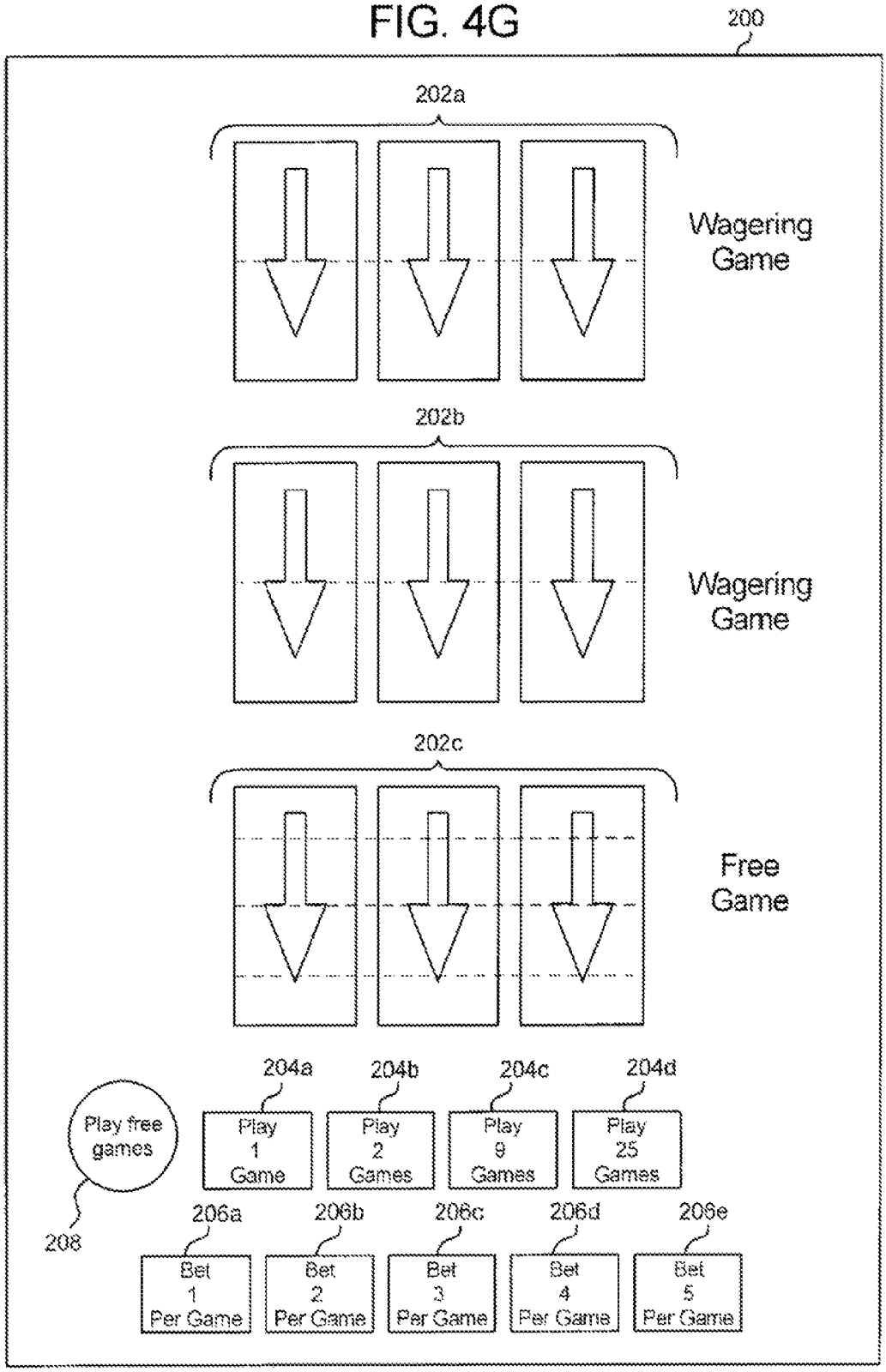

As illustrated in FIG. 4G, the display device displays the reels spinning 202*a*, 202*b*, and 202*c*, to generate a game outcome for each slot game.

Figure 4H:
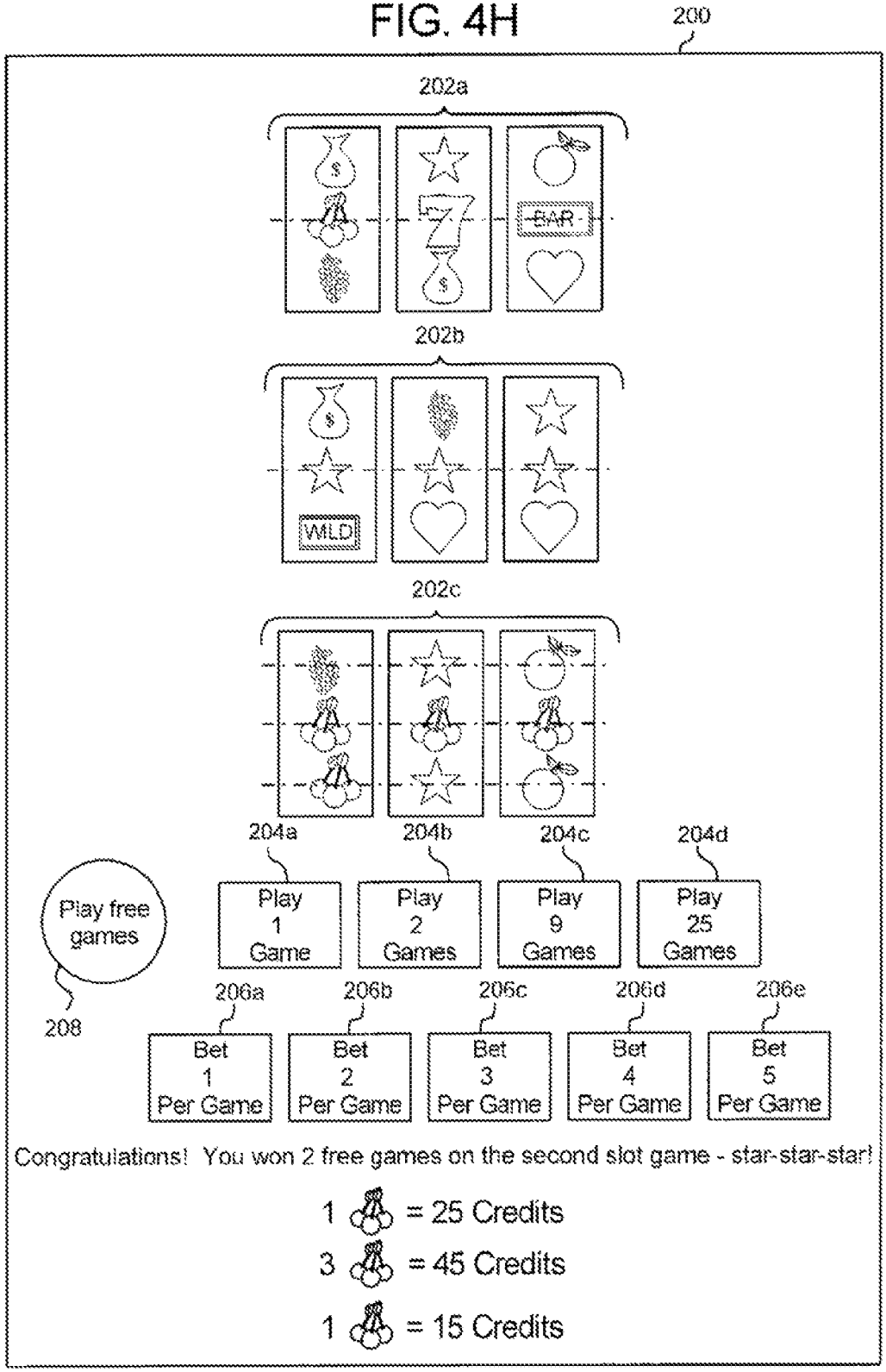

As illustrated in FIG. 4H, the gaming system generates and displays a symbol combination of a seven symbol, a cherry symbol and a bar symbol on the payline of the first slot game 202*a*. The gaming system provides the player an award of 25 credits for the generated cherry symbol. The third slot game 202*c* generates three cherry symbols on the middle payline. Accordingly, the gaming system provides the player an award of 75 credits. Additionally, the third slot game 202*c* generates one cherry symbol on the lower payline. Accordingly, the gaming system provides the player an award of 15 credits for the generated cherry symbol.

As illustrated in FIG. 4H, the second slot game 202*b* generates the free game triggering symbol combination of three star symbols on the payline. The gaming system provides the player two free games for that played slot wagering game.

Figure 4I:
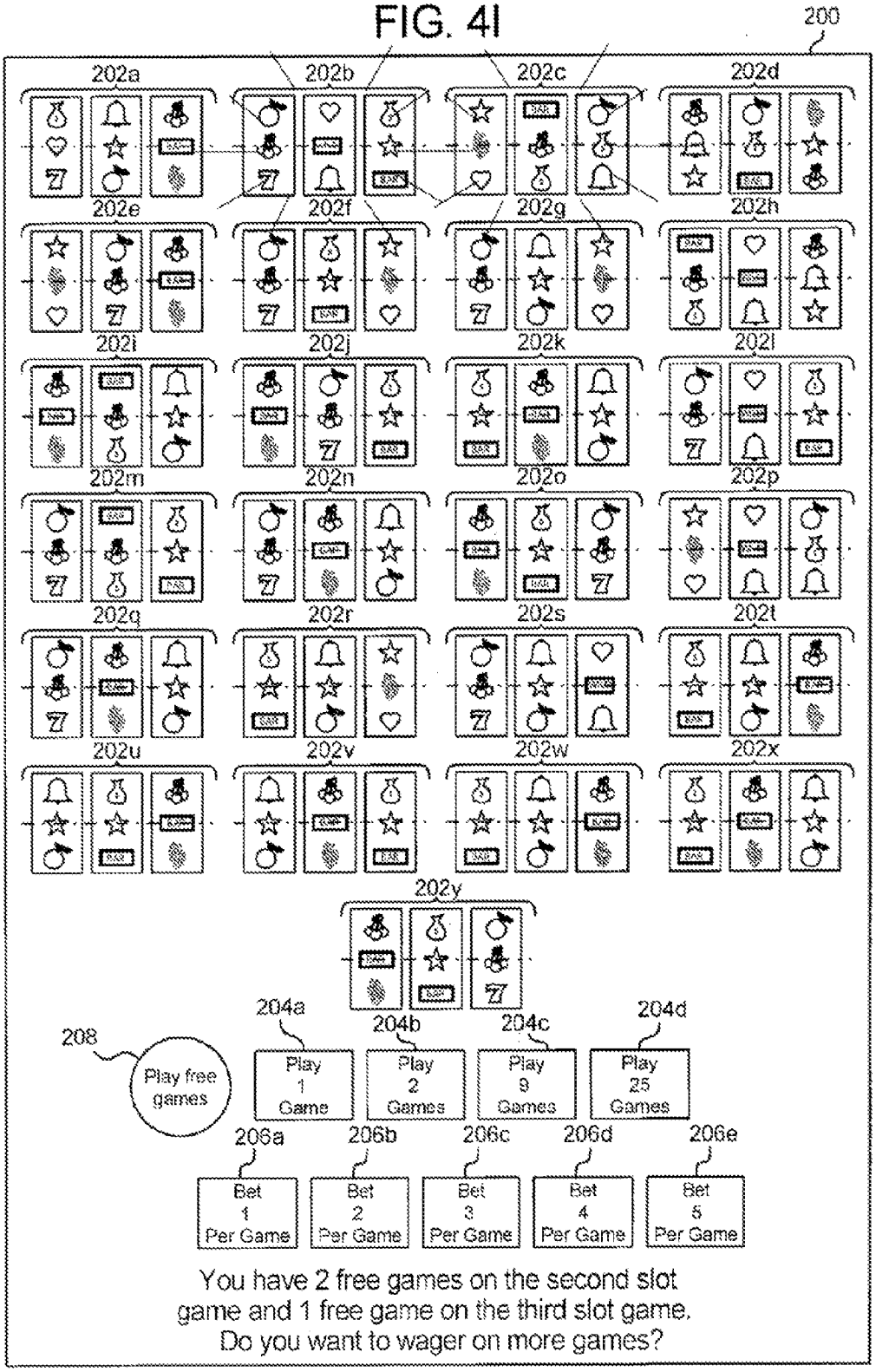

As illustrated in FIG. 4I, the gaming system communicates to the player the player's options. The player has two free games on the second slot game 202*b* and one free game on the third slot game 202*c*. In the illustrated embodiment, the player may play one, two or three free games simultaneously with a plurality of the wagering games.

Figure 4J:
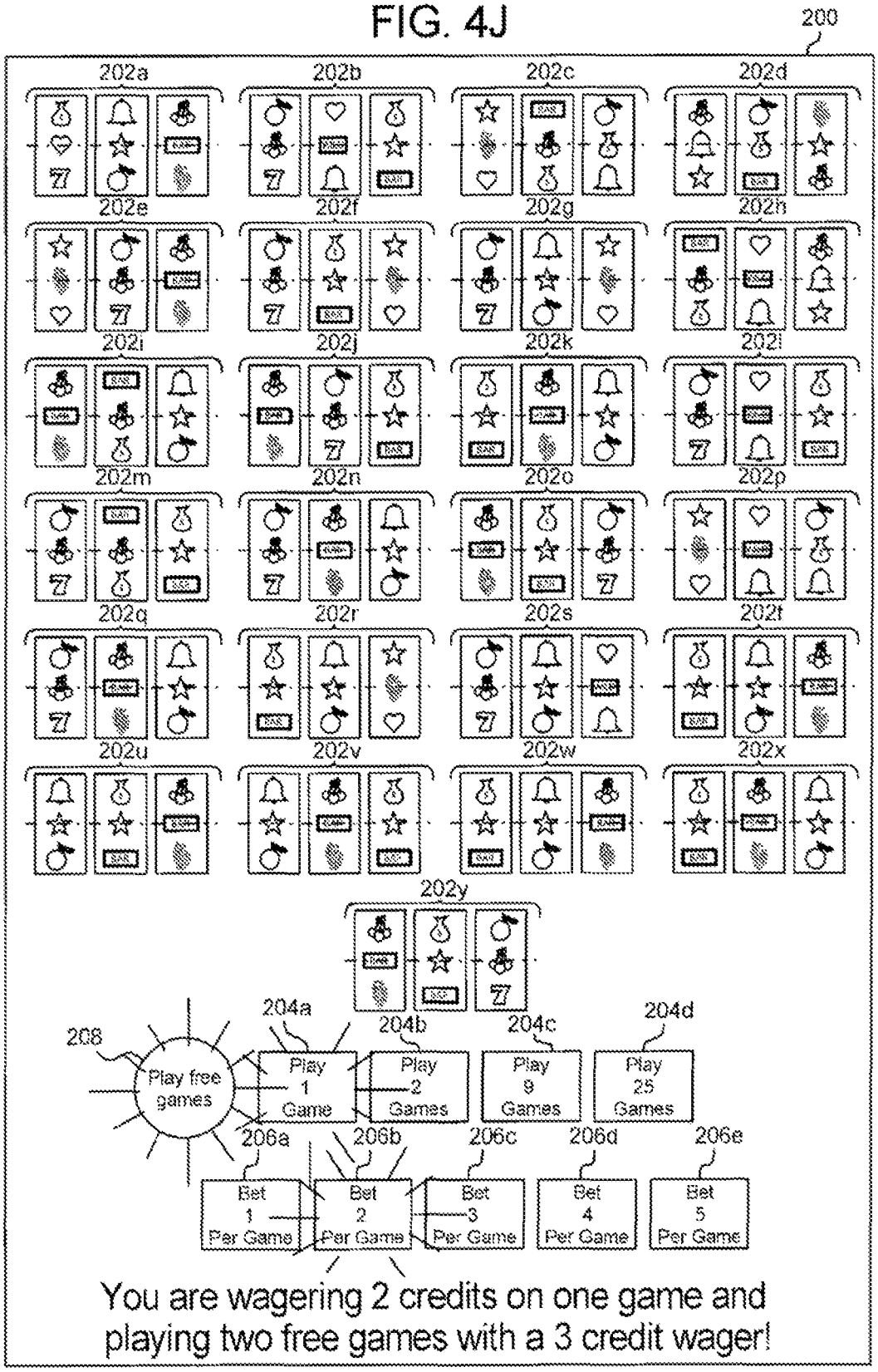

As illustrated in FIG. 4J, the player makes an input to play a free game for the second slot game 202*b* and the third slot game 202*c* and to play one wagering game. The player wagers two credits on the wagering game.

Figure 4K:
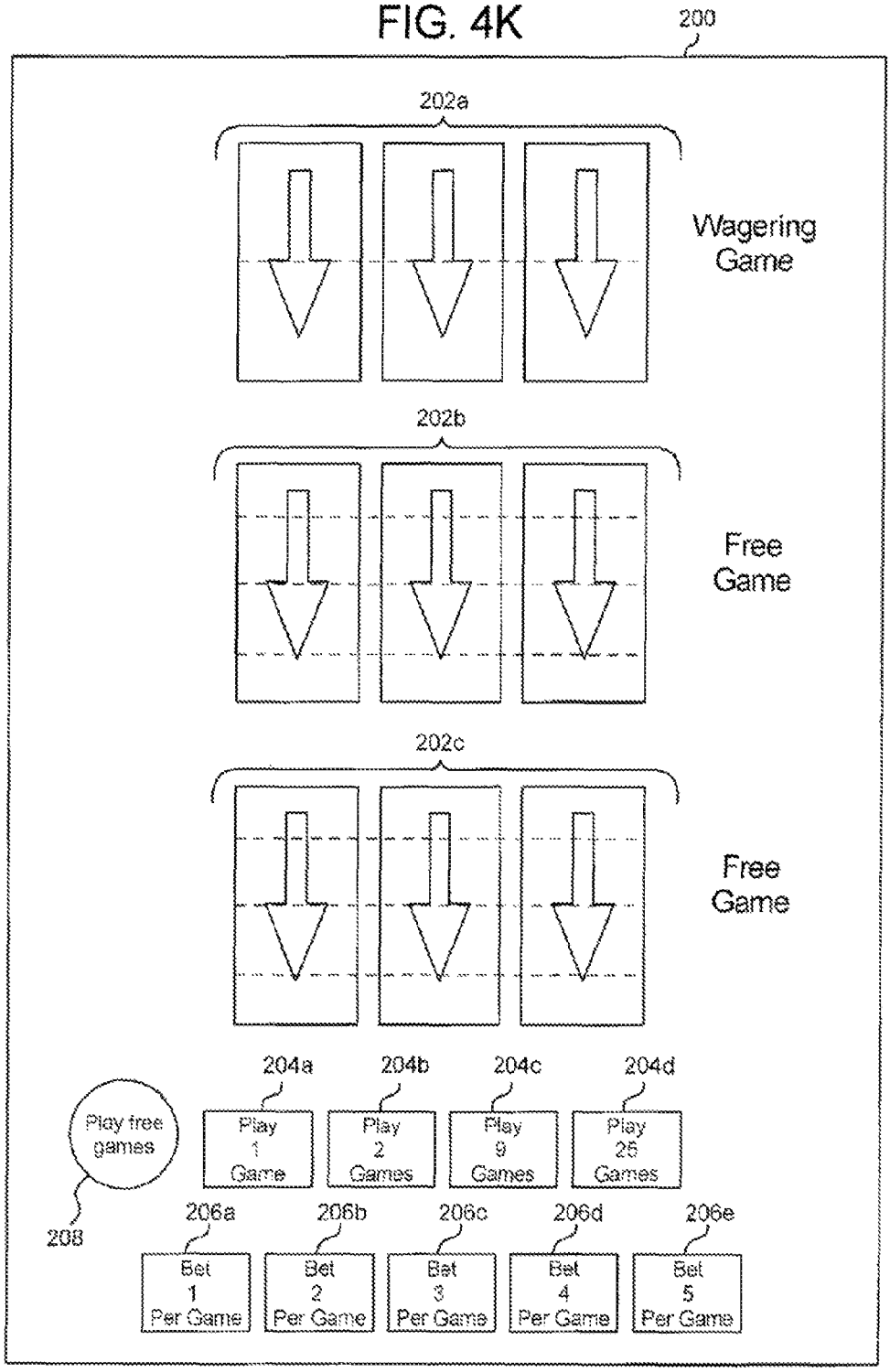

As illustrated in FIG. 4K, in one embodiment the display device of the gaming system zooms in to highlight the three slot games that the player is simultaneously playing. As illustrated, the two free slot games include three paylines where the wagered on slot game only includes one payline. In another embodiment, one, a plurality or each of the games are displayed by the central display.

Figure 4L:
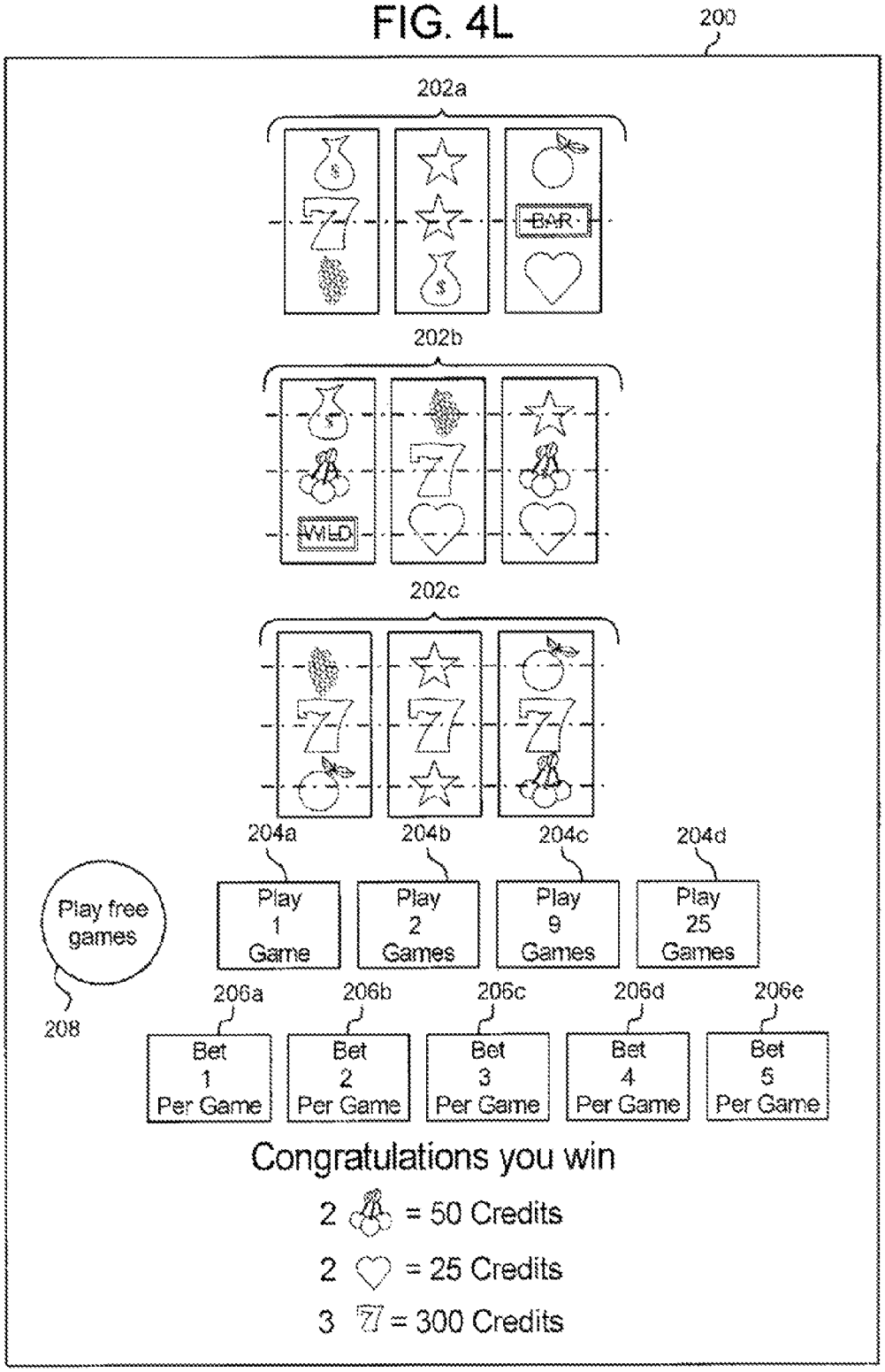

As illustrated in FIG. 4L, the display device displays game outcomes for the three slot games. The first slot game 202*a* did not generate a winning outcome on the payline. The second slot game 202*b* generated two cherry symbols on the middle payline. The gaming system provides the player with an award of 50 credits for the two cherry symbols determined by the five credits wagered on the triggering game and on a paytable. The third slot game 202*c* generated the combination of three seven symbols on the middle payline. The gaming system provides an award of 300 credits to the player for the three seven symbols. Additionally, the gaming system generated two hearts on the lower payline and provides the player 25 credits for this winning game outcome.

Figure 4M:
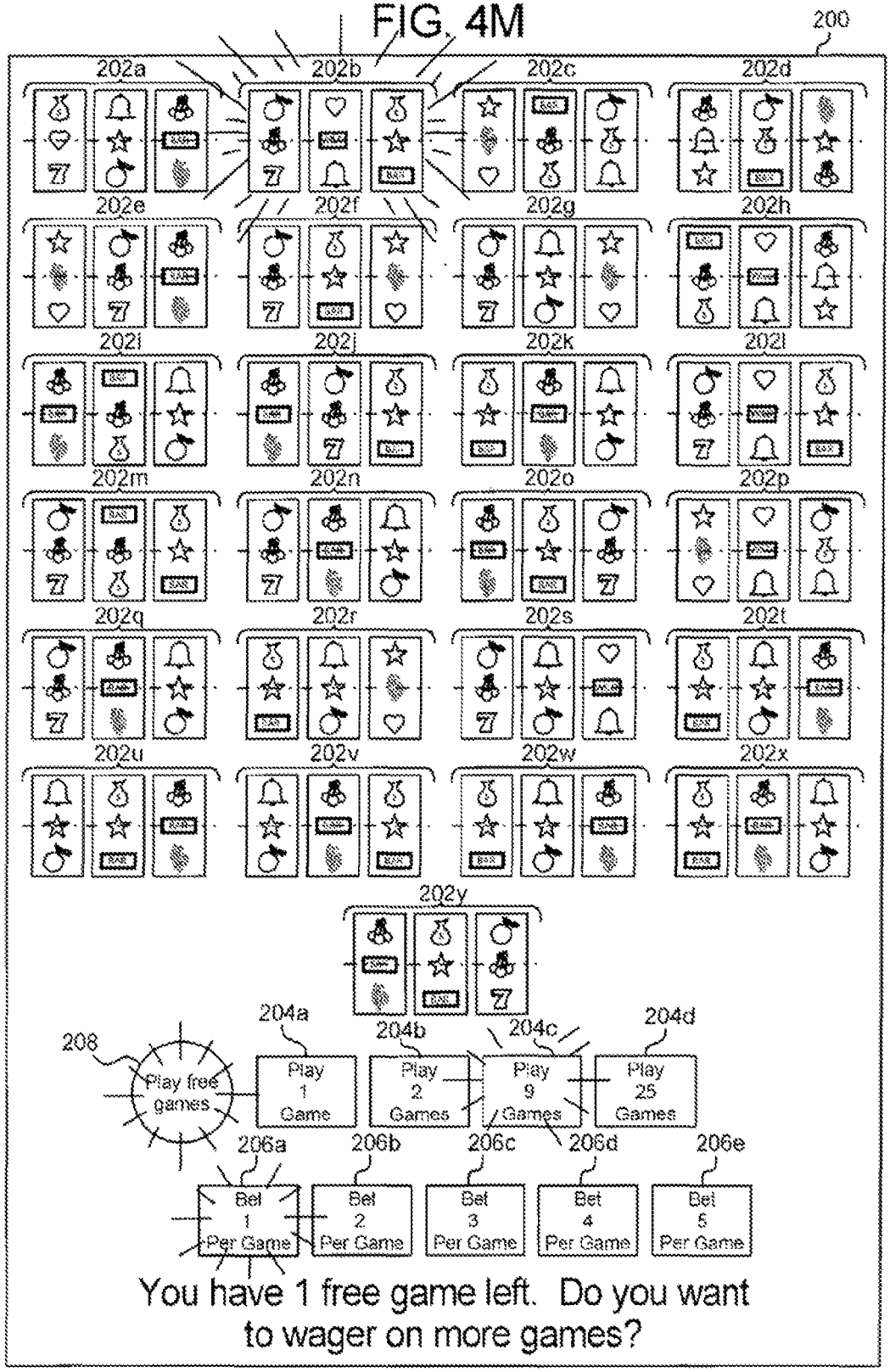
Figure 4N:
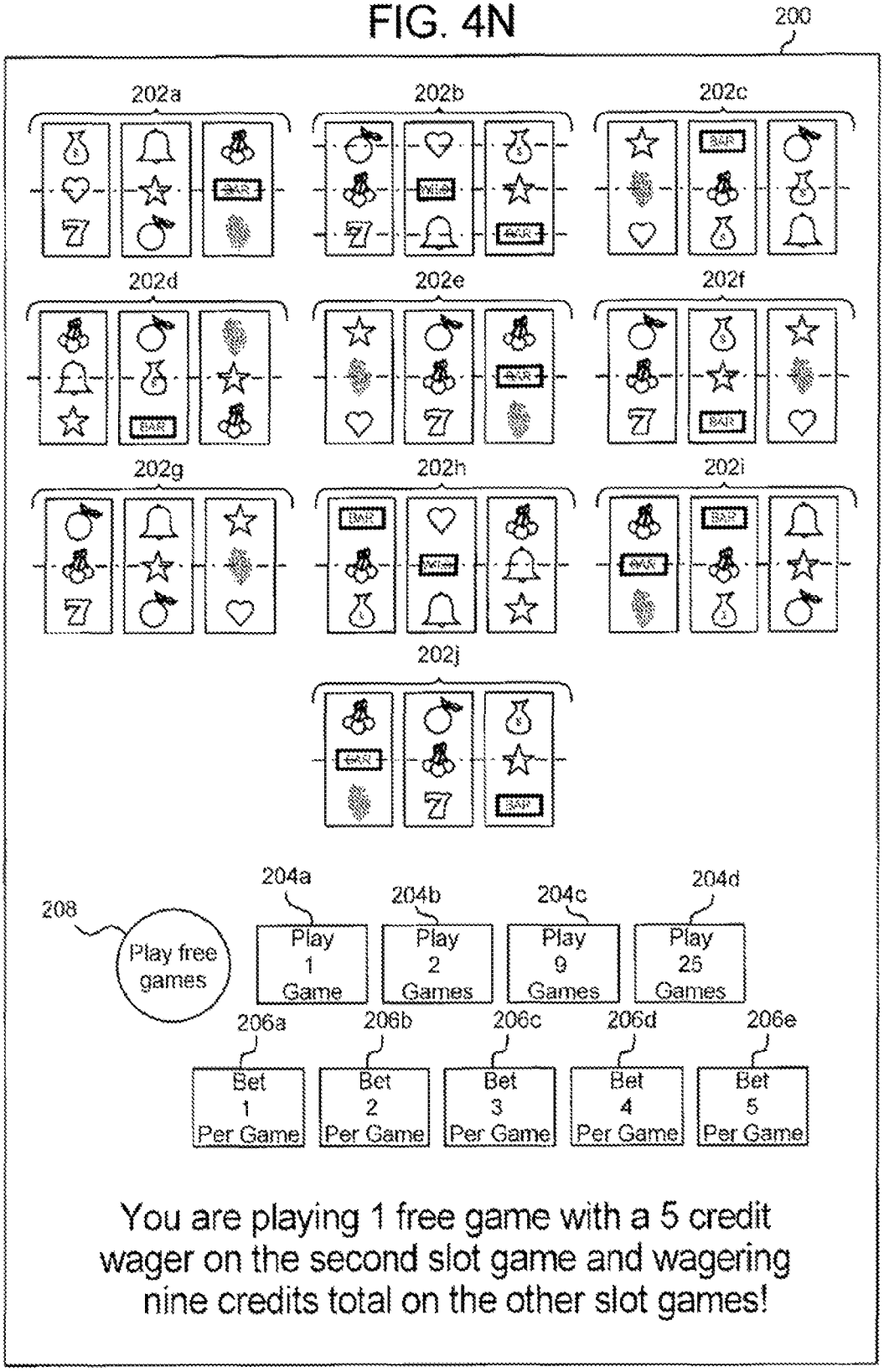

As illustrated in FIG. 4M, the display device communicates to the player that the player has one free game remaining. In one embodiment, the gaming system displays the available free game highlighted. The player makes an input to play the remaining free game and to wager 1 credit on 9 games.

As illustrated in 4N, the display device enlarges the slot games that the player is going to play. The free game 202*b* includes three paylines. The wagering games only include one payline.

Figure 4O:
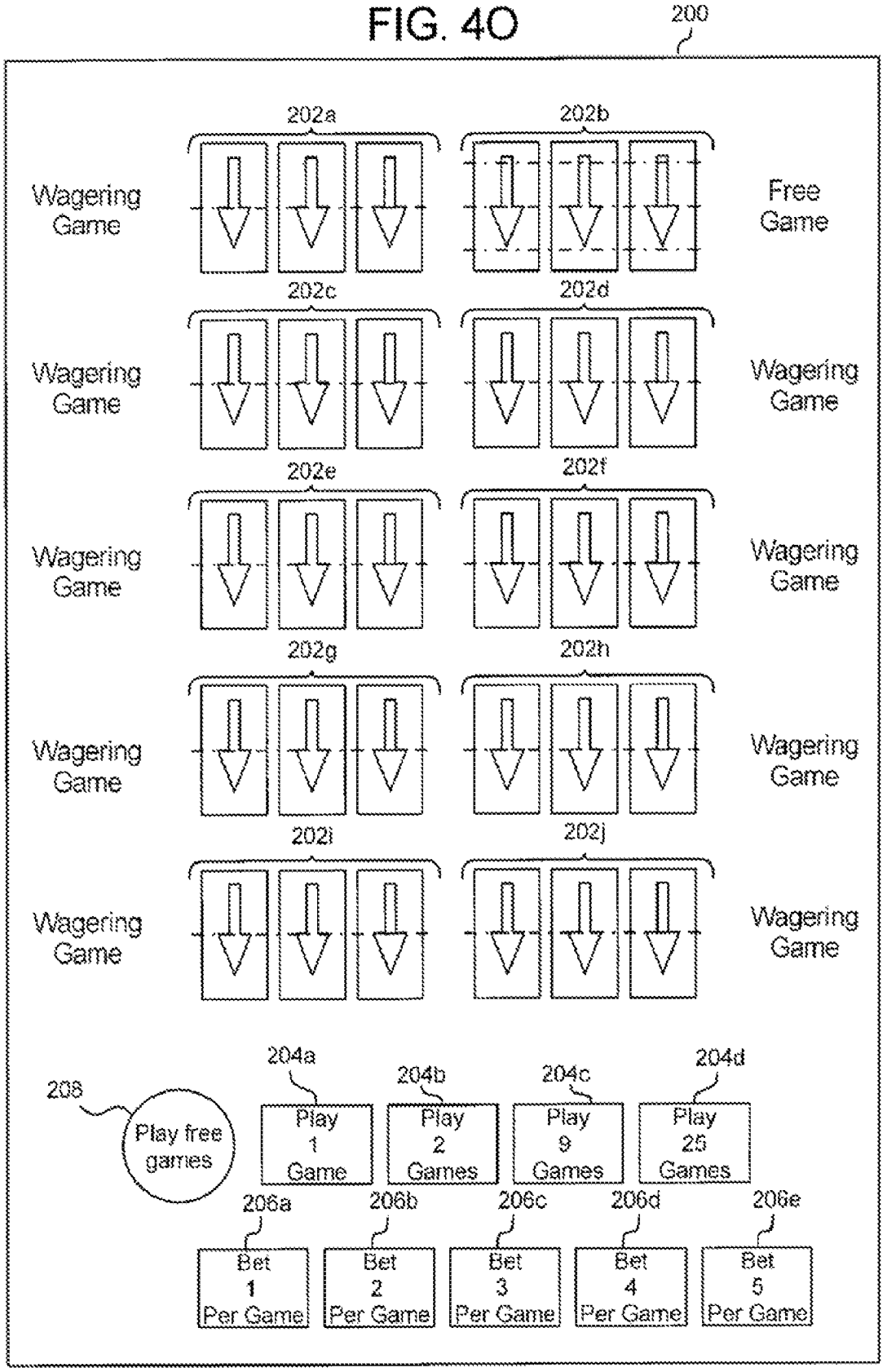

As illustrated in FIG. 4O, the display device displays each of the slot games reels spinning to generate an outcome for each of the games.

Figure 4P:
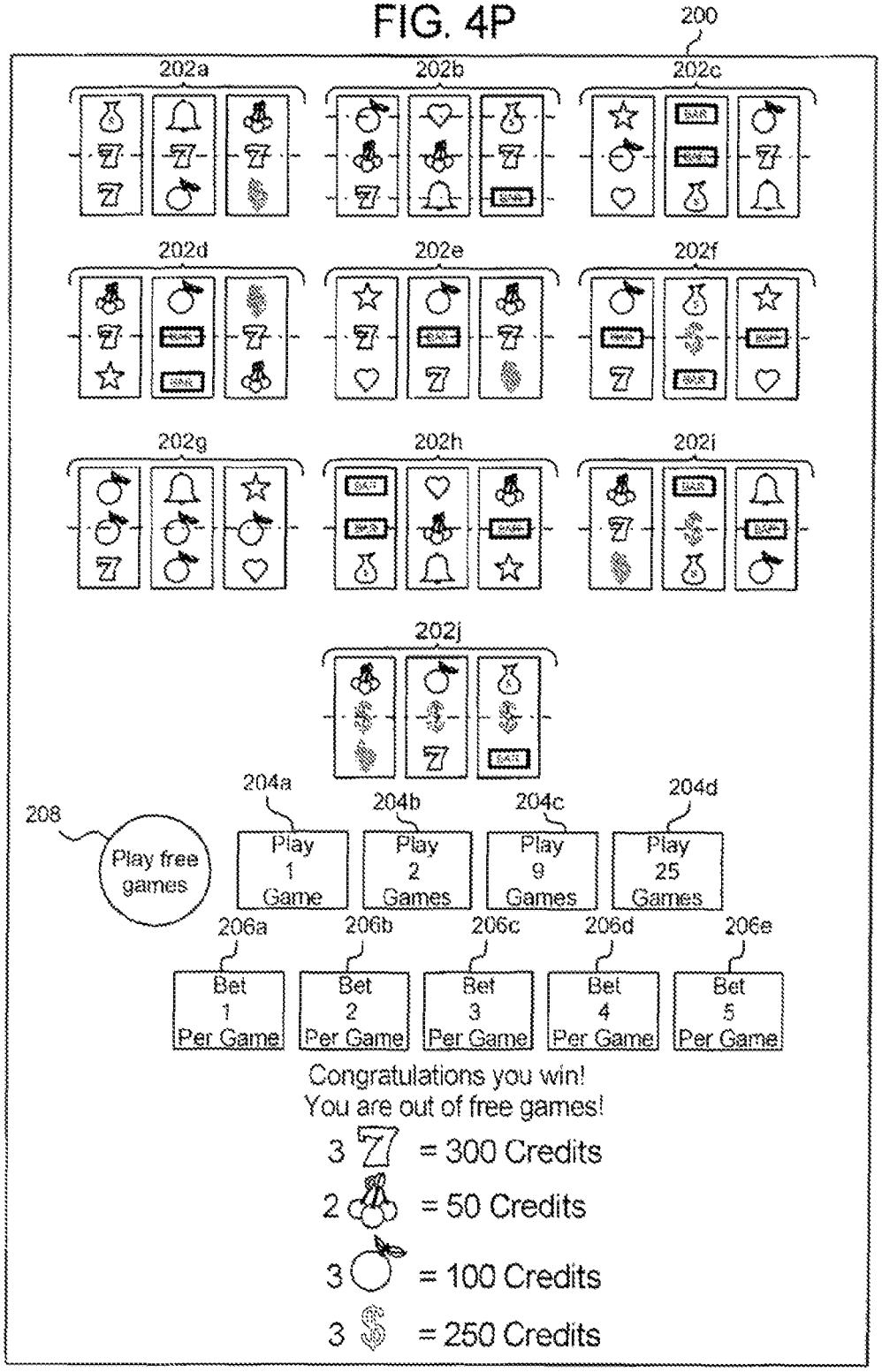

As illustrated in FIG. 4P, the gaming system generates some winning and non-winning symbol combinations. The gaming system provides an award to the player for the winning symbol combinations. The player has played all of the free games and did not win any more free games in the last play of the gaming system. The player therefore may wager again to try to win more awards and more free games.

It should be appreciated that the game may be any suitable game and may include any suitable number of games.

As illustrated in FIGS. 5A, 5B, 5C, 5D, 5E, 5F, 5G, 5H, 5I, 5J, 5K and 5L, in one embodiment, the gaming system includes nine five card poker games. The poker games are associated with a paytable that includes award amounts for traditional winning poker combinations (e.g. two of a kind, full house, straight, royal flush, etc.). The player may win free games upon the occurrence of a free game triggering event in any of the poker games. The free game triggering event for each of the games is a final hand of two of a kind. For each occurrence of the free game triggering event, the player wins two free poker games.

Figure 5A:
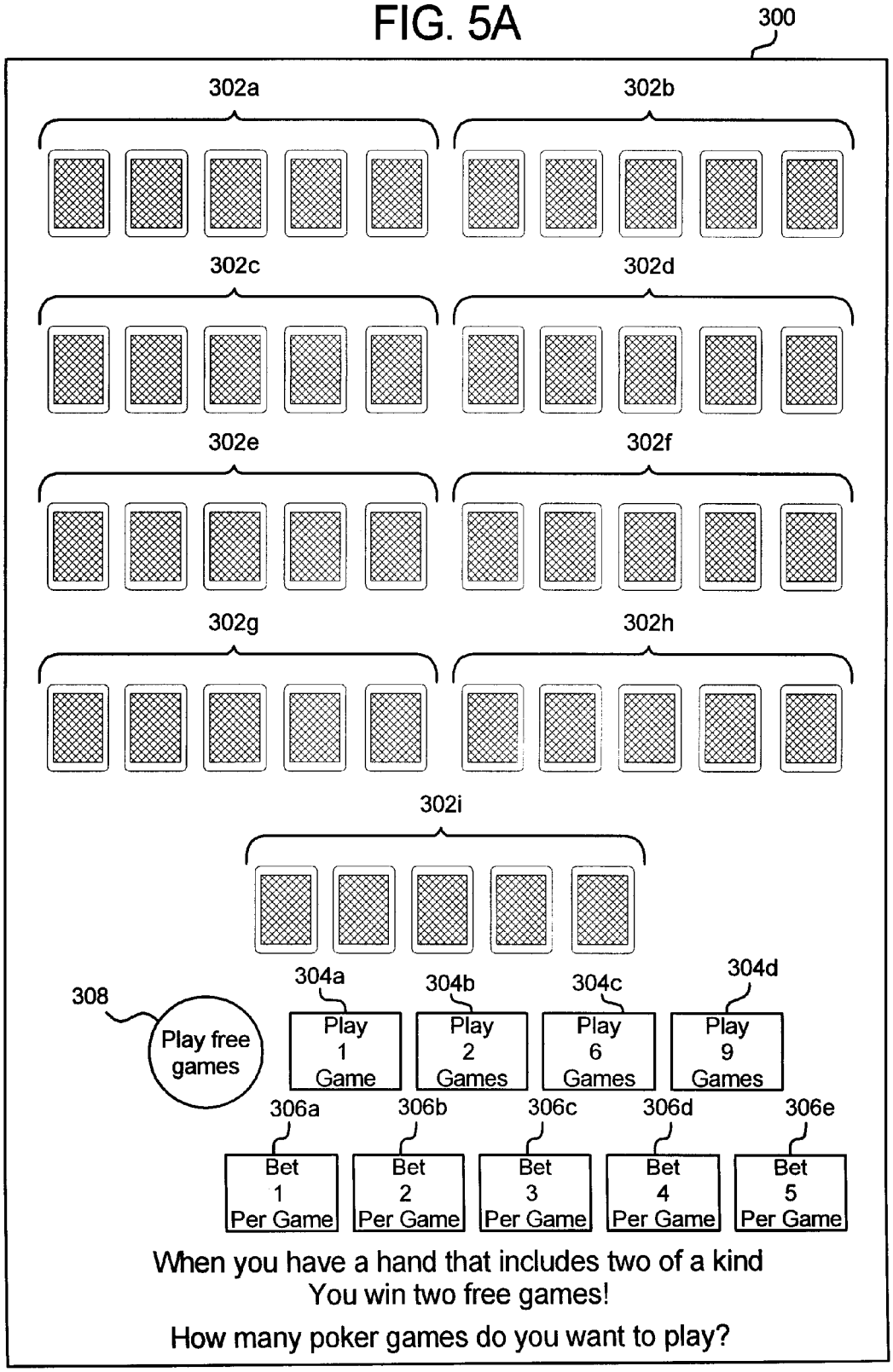
FIGS. 5A, 5B, 5C, 5D, 5E, 5F, 5G, 5H, 5I, 5J, 5K, and 5L are front views of a display device of one poker embodiment disclosed herein, illustrating a gaming device enabling a player to wager on a plurality of poker games and to simultaneously play a plurality of free poker games and wagering poker games.

FIG. 5A illustrates 9 separate five-card poker games 302*a*, 302*b*, 302*c*, 302*d*, 302*e*, 302*f*, 302*g*, 302*h* and 302*i* displayed on a display device 264. The display device includes a play free games input 310, a plurality of inputs that enable a player to play certain numbers of games 304*a* to 304*d* and inputs enabling the player to wager different credit amounts for the games 306*a* to 306*e*. In another embodiment, the display device of a player station and/or the individual display segments of the central display display the games, as explained above. In one embodiment, for each game, the gaming system enables the player to determine whether to hold a card or discard a card and therefore get a new card. The gaming system determines a game outcome and/or award for each final card hand based on a paytable.

As illustrated FIG. 5A, in this embodiment, the gaming system provides the player the option of playing 1 game 306*a*, playing 2 games 306*b*, playing 6 games 50*c* or playing 9 games 306*d*. The player may bet 1 credit 306*a*, 2 credits 306*b*, 3 credits 306*c*, 16 credits 306*d* or 5 credits 306*e* per game.

Figure 5B:
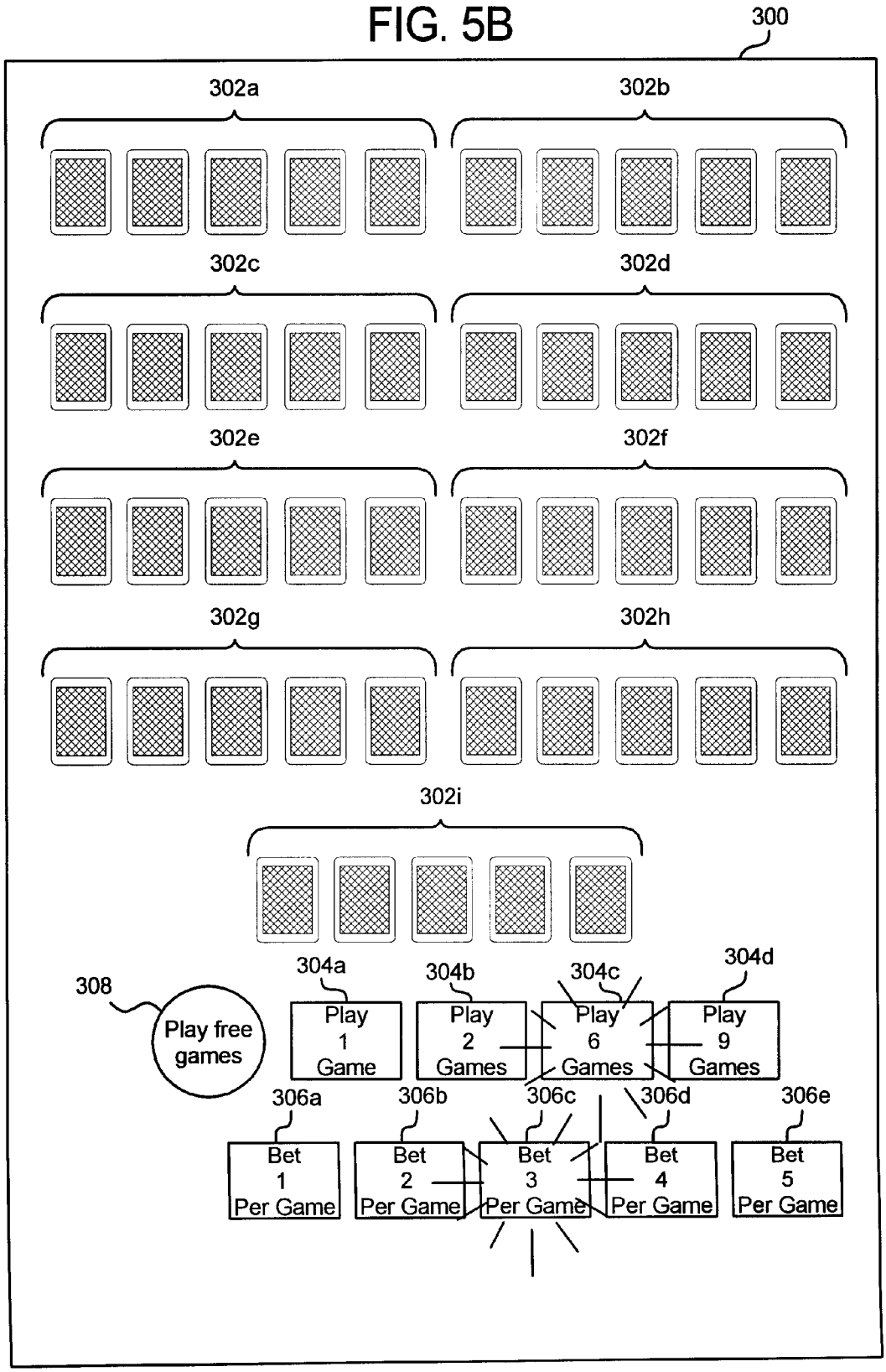

As illustrated in FIG. 5B, the player wagers three credits per game on six games. In the illustrated embodiment, the free game triggering event is a card hand including two of a kind. That is, when a final hand of the poker game includes any two of the same numbered cards, the gaming system awards the player 2 free games.

Figure 5C:
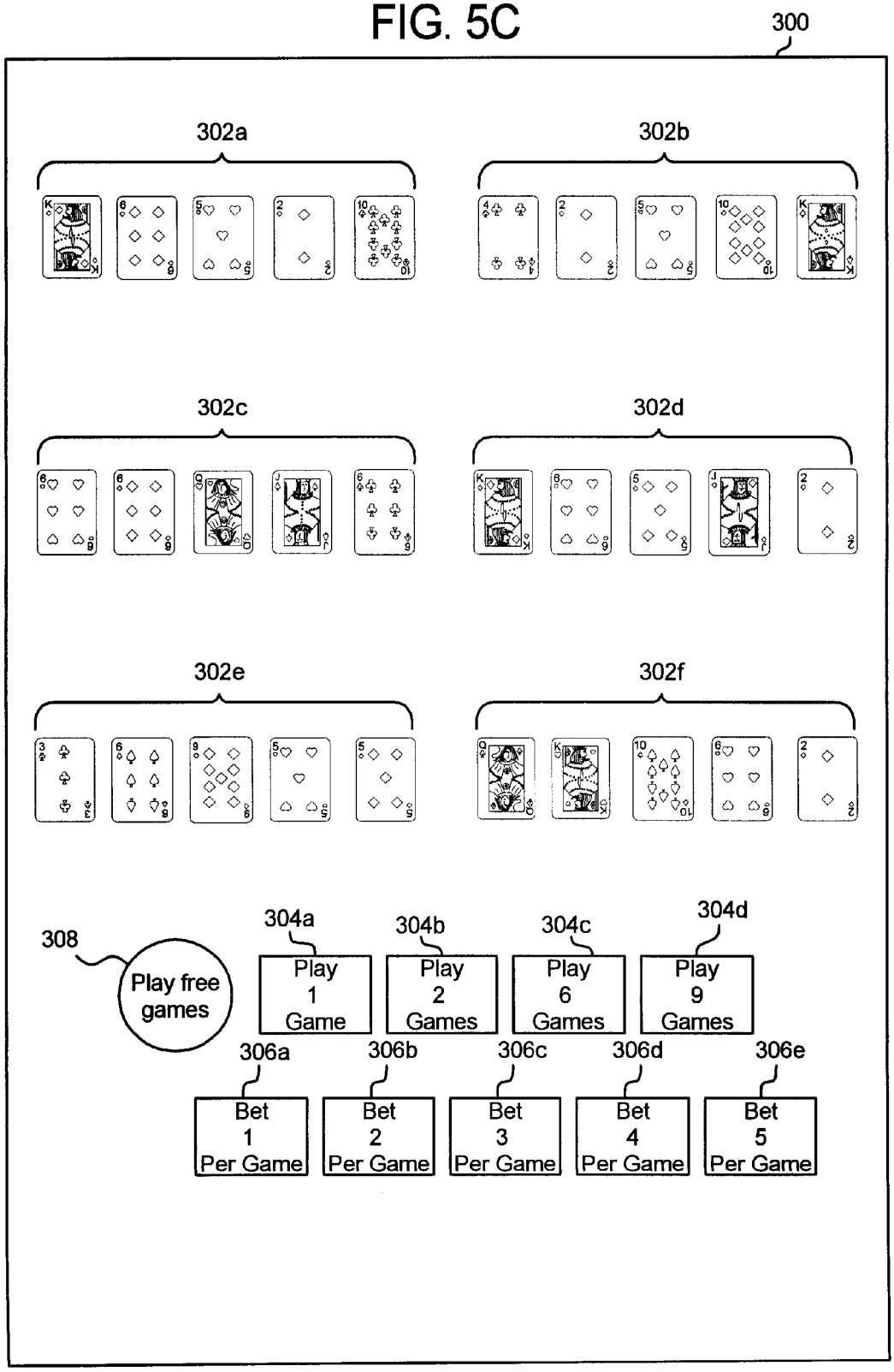

As illustrated in FIG. 5C, the display device displays five initial card hands for each of the poker games 302*a*, 302*b*, 302*c*, 302*d*, 302*e*, and 302*f*. The first poker hand 302*a* includes a king of diamonds, a six of diamonds, a five of hearts, a two of diamonds and a ten of clubs. The second poker hand 302*b* includes a four of clubs, a two of diamonds, a five of hearts, a ten of diamonds and a king of spades. The third poker hand 302*c* includes a six of hearts, a six of diamonds, a queen of hearts, a jack of spades and a six of clubs. The fourth poker hand 302*d* includes a king of diamonds, a six of hearts, a five of diamonds, a jack of diamonds, and a two of diamonds. The fifth poker hand 302*e* includes a three of clubs, a six of spades, a nine of diamonds, a five of hearts and a five of diamonds. The sixth poker hand 302*f* includes a queen of clubs, a king of hearts, a ten of spades, a six of hearts and a two of diamonds.

Figure 5D:
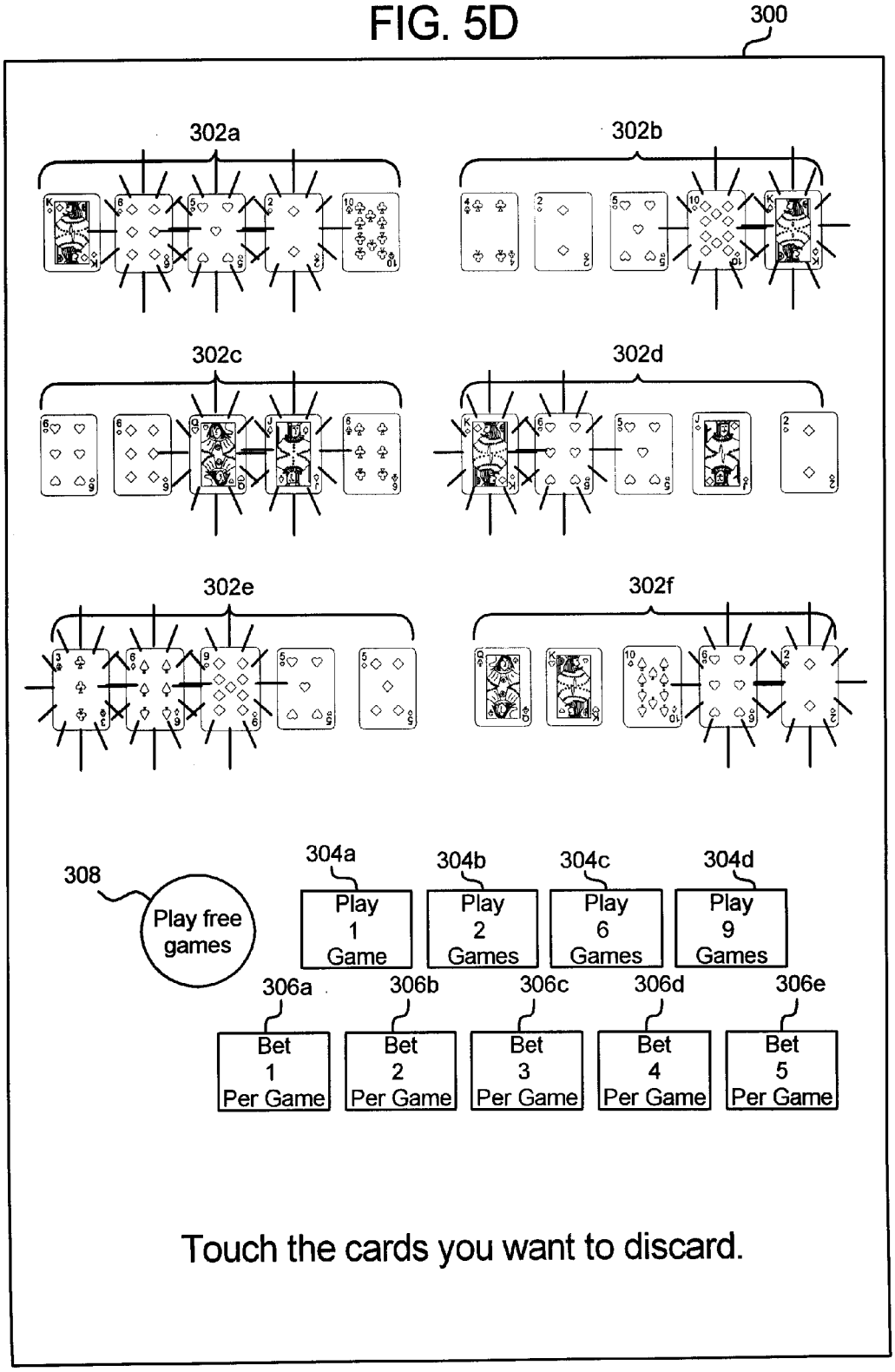

As illustrated in FIG. 5D, the gaming system enables the player to touch the cards that the player wants to discard. The player may discard up to three cards in each game.

In the first poker game 302*a*, the player discards all of the cards but the king of diamonds and the ten of clubs. In the second poker game 302*b*, the player discards the king of spades and the ten of diamonds. In the third poker game 302*c*, the player discards the queen of hearts and the jack of spades. In the fourth poker game 302*d*, the player discards the king of diamonds and the six of hearts. In the fifth poker game 302*e*, the player discards the three of clubs, the six of spades and the nine of diamonds. In the sixth poker game 302*f*, the player discards the six of hearts and the two of diamonds.

Figure 5E:
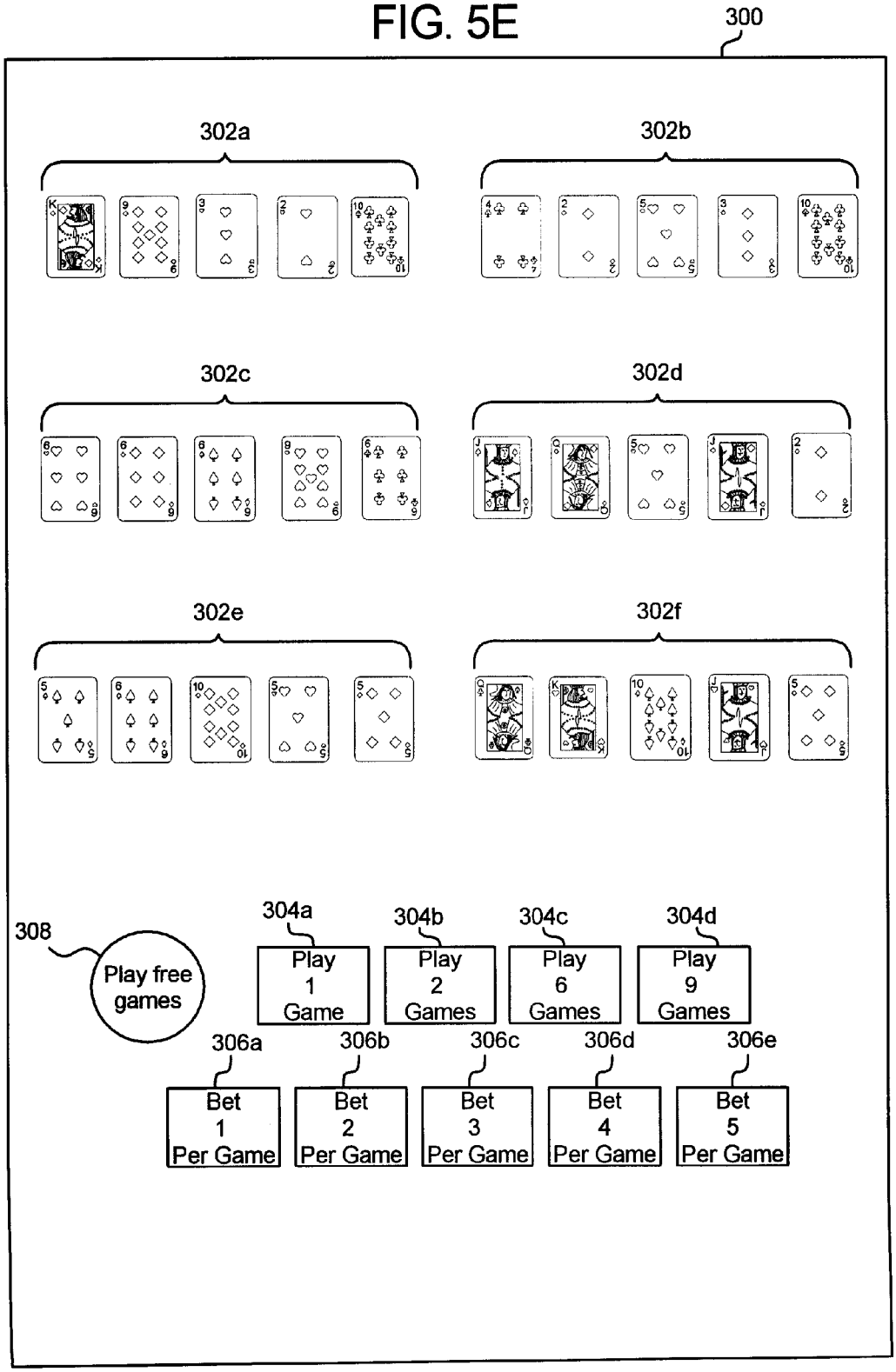
Figure 5F:
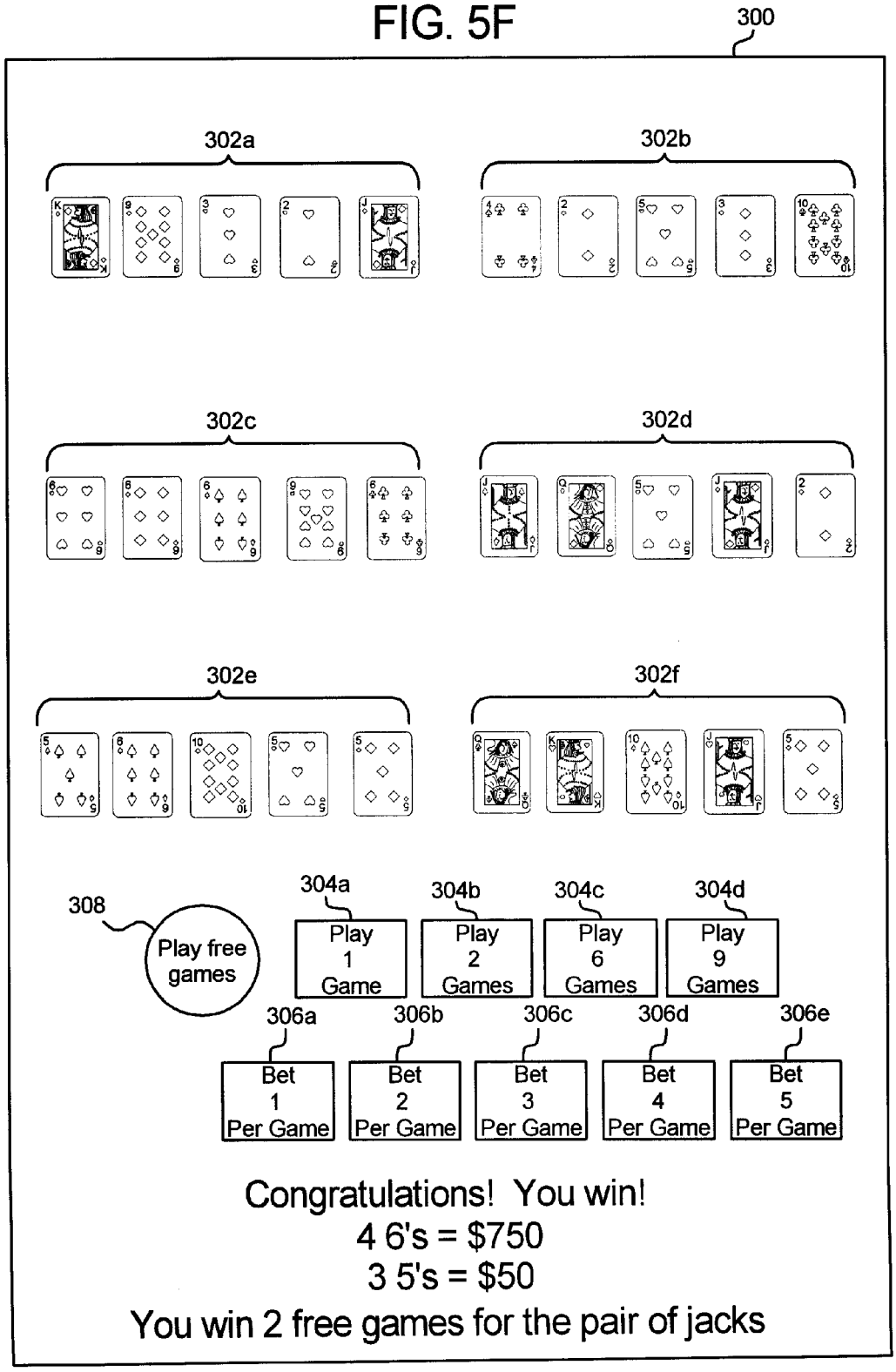

As illustrated in FIG. 5E, the gaming system generates and displays new cards for each of the discarded cards. In the first poker game 302*a*, the player receives a nine of diamonds, three of hearts, and a two of hearts. The gaming system evaluates this hand and determines that it is not a winning hand, as indicated in FIG. 5F.

In the second poker game 302*b*, the gaming system generates a three of diamonds and a ten of clubs to replace the two discarded cards as illustrated in FIG. 5E. This second poker game does not generate an award or a winning outcome for the player.

In the third poker game 302*c*, the gaming system generates a six of spades and a nine of hearts. This combination results in four six's. This combination is a winning combination. As illustrated on FIG. 5F, the gaming system provides the player an award of $750 for the four six's.

In the fourth poker game 302*d*, the gaming system generates a jack of spades and a queen of diamonds. This provides the free game triggering event of two of a kind in a single game. As illustrated in FIG. 5F, the gaming system informs the player that they win two free games for the two jacks.

In the fifth poker game 302*e*, as illustrated in FIG. 5E, the gaming system provides the player a five of spades, a six of spades and a ten of diamonds. The combination of three fives, is three of a kind. As illustrated in FIG. 5F, the gaming system informs the player that they win $50 for the three of a kind.

In the sixth poker game 302*f*, the gaming system provides the player a five of diamonds and a jack of hearts. This is not a winning combination.

Figure 5G:
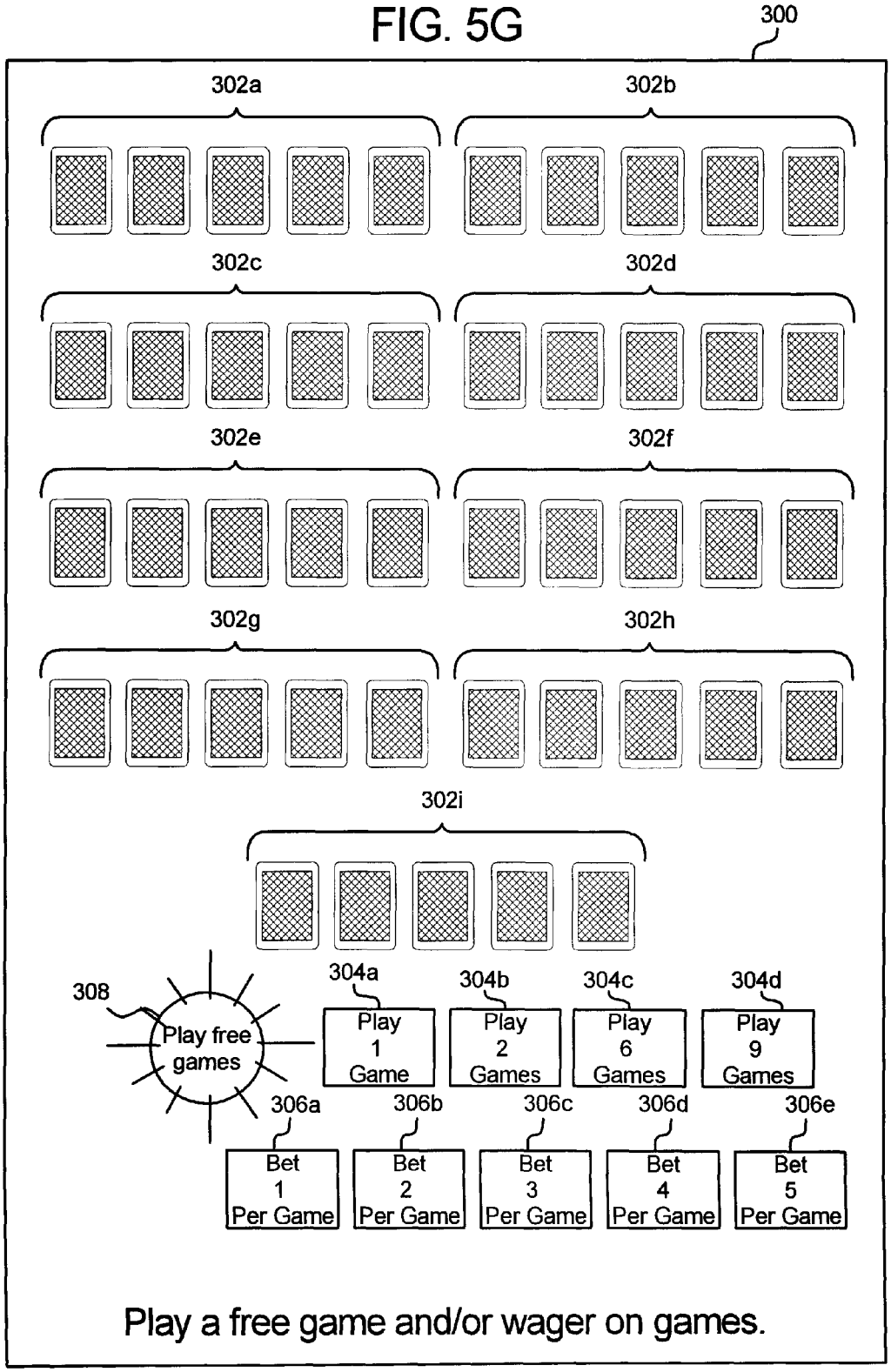

As illustrated in FIG. 5G, the gaming system provides the player with game options of playing one of the two free games and to wager on any wagering games. The player makes an input to only play a free game.

Figure 5H:
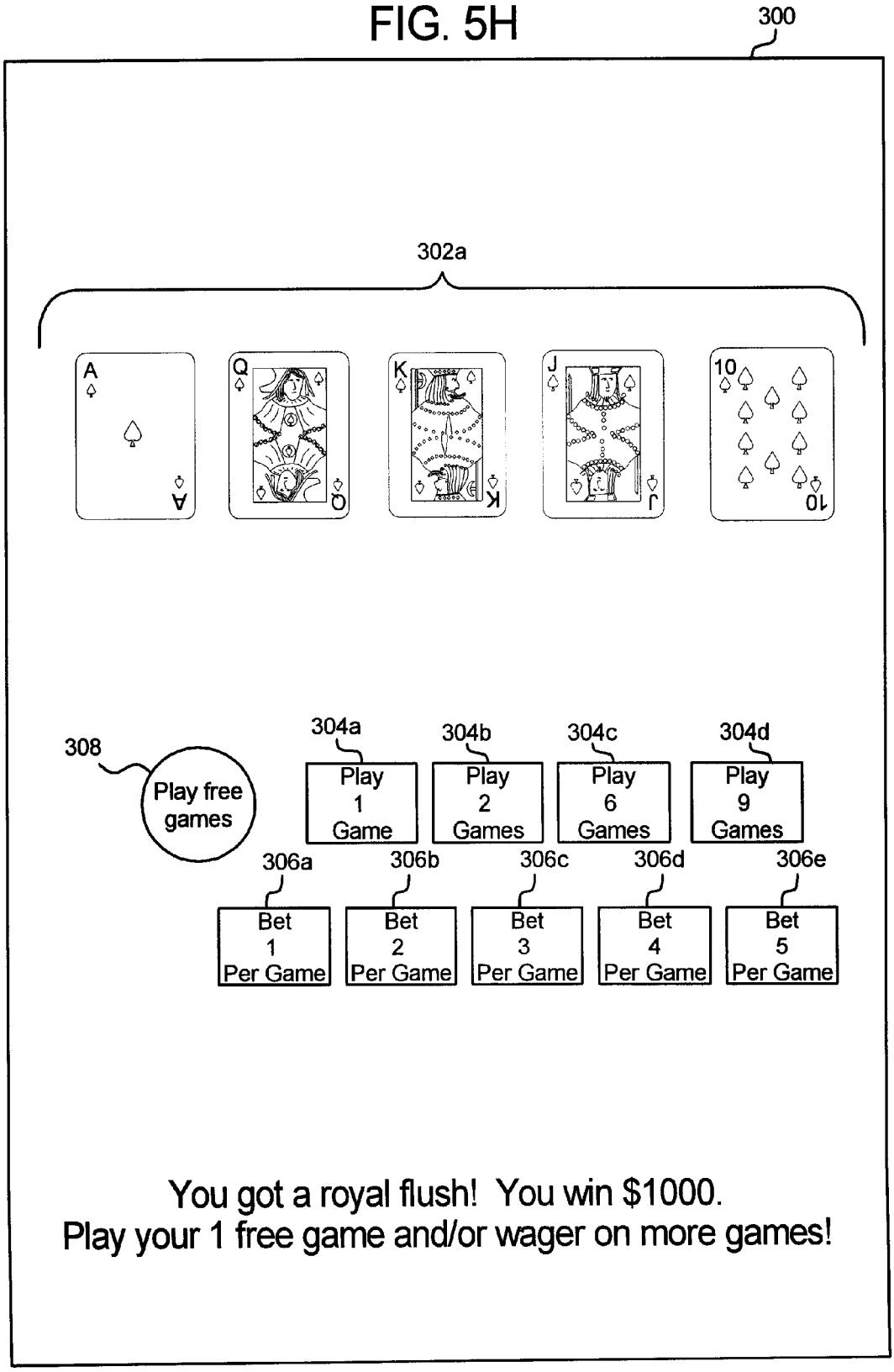

As illustrated in FIG. 5H, the gaming system generates and displays a 5-card poker hand to the player. The hand includes an ace of spades, a queen of spades, a king of spades, a jack of spades and a ten of spades. This card combination is a royal flush. The player does not discard any cards and wins $1000 from the free game. The gaming system informs the player that the player may play the one remaining free game simultaneously with and/or wager on one or more wagering games.

Figure 5I:
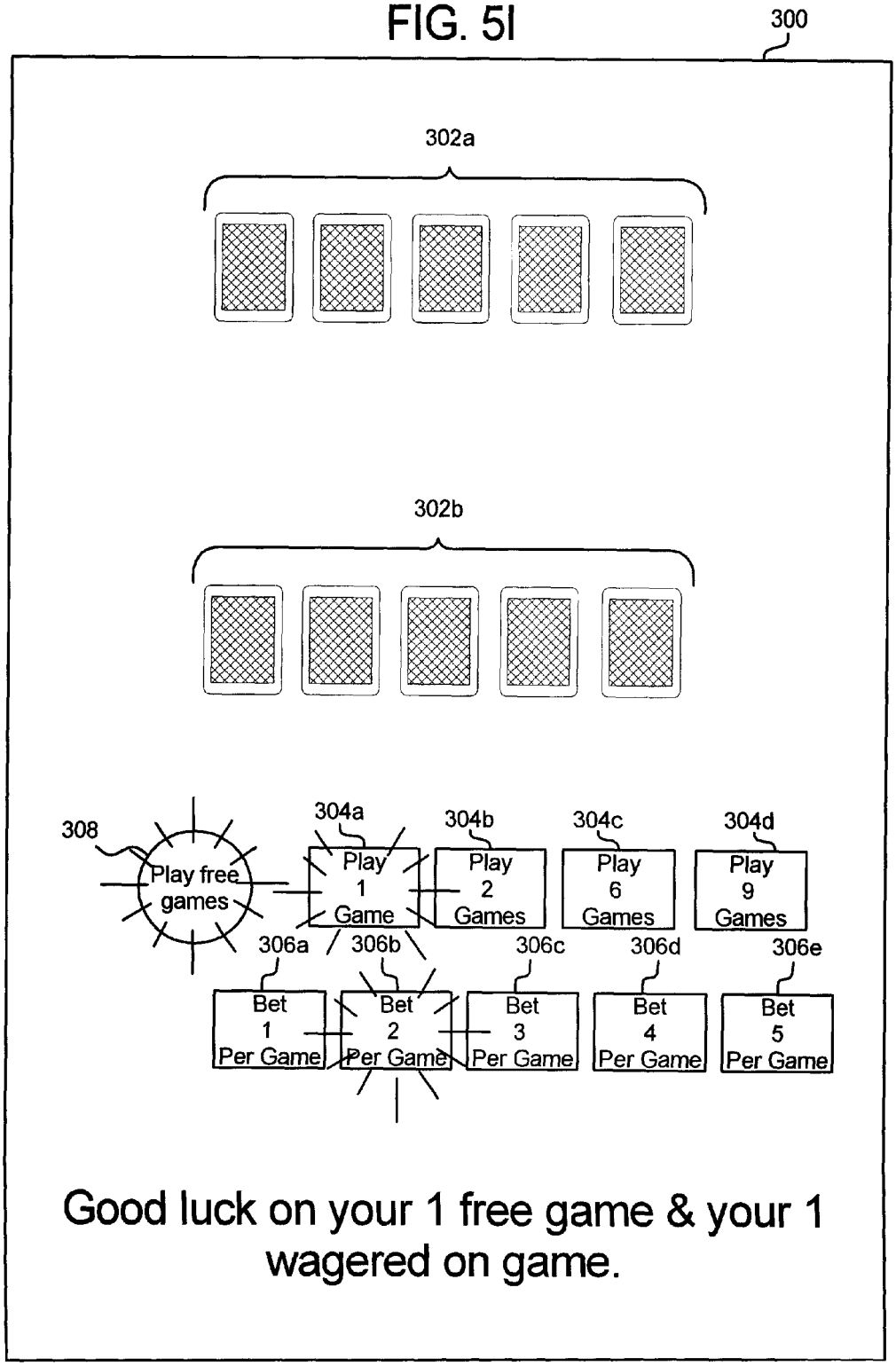

As illustrated in FIG. 5I, the player plays the remaining free game and wagers two credits on one wagering game.

Figure 5J:
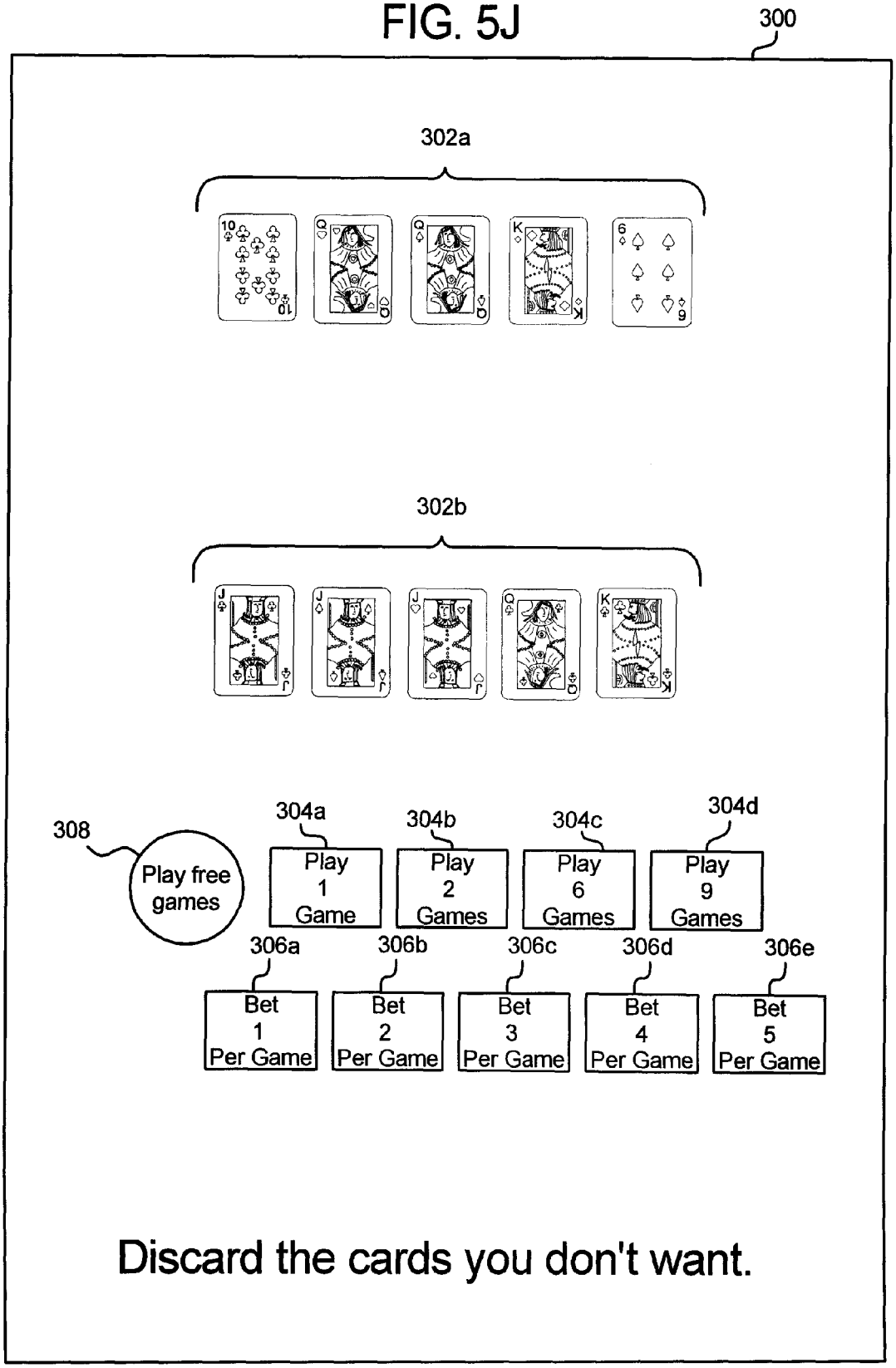
Figure 5K:
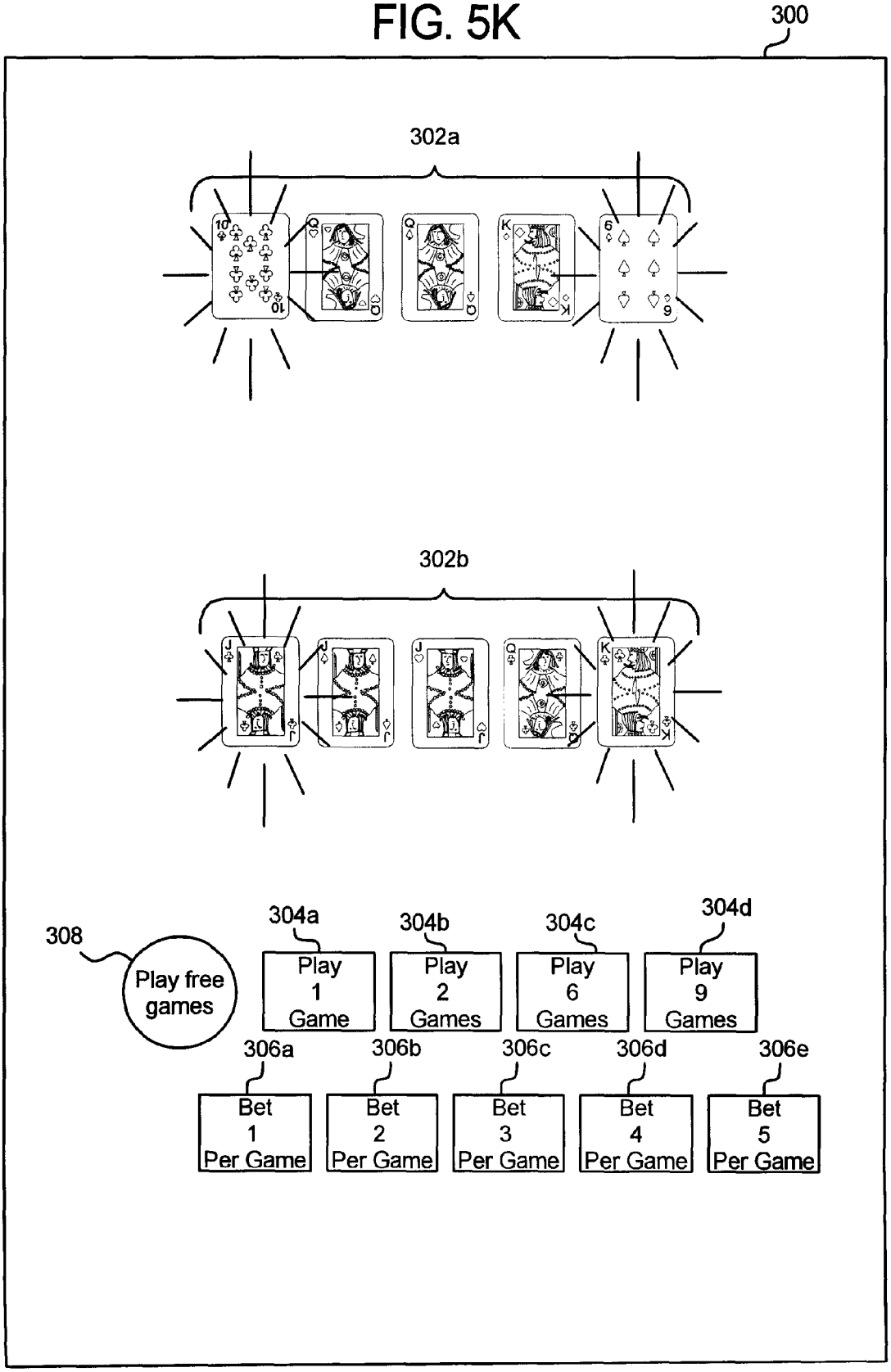

As illustrated in FIG. 5J, the gaming system generates and displays the two poker games. For the first game, the player receives a ten of clubs, a queen of hearts, a queen of spades, a king of diamonds and a six of spades. As illustrated in FIG. 5K, the player discards the ten of clubs and the six of spades.

As illustrated in FIG. 5J, for the second game, the gaming system generates and displays a jack of clubs, a jack of spades, a jack of hearts, queen of clubs and a king of hearts. As illustrated in FIG. 5K, the player discards the queen of clubs and the king of clubs.

Figure 5L:
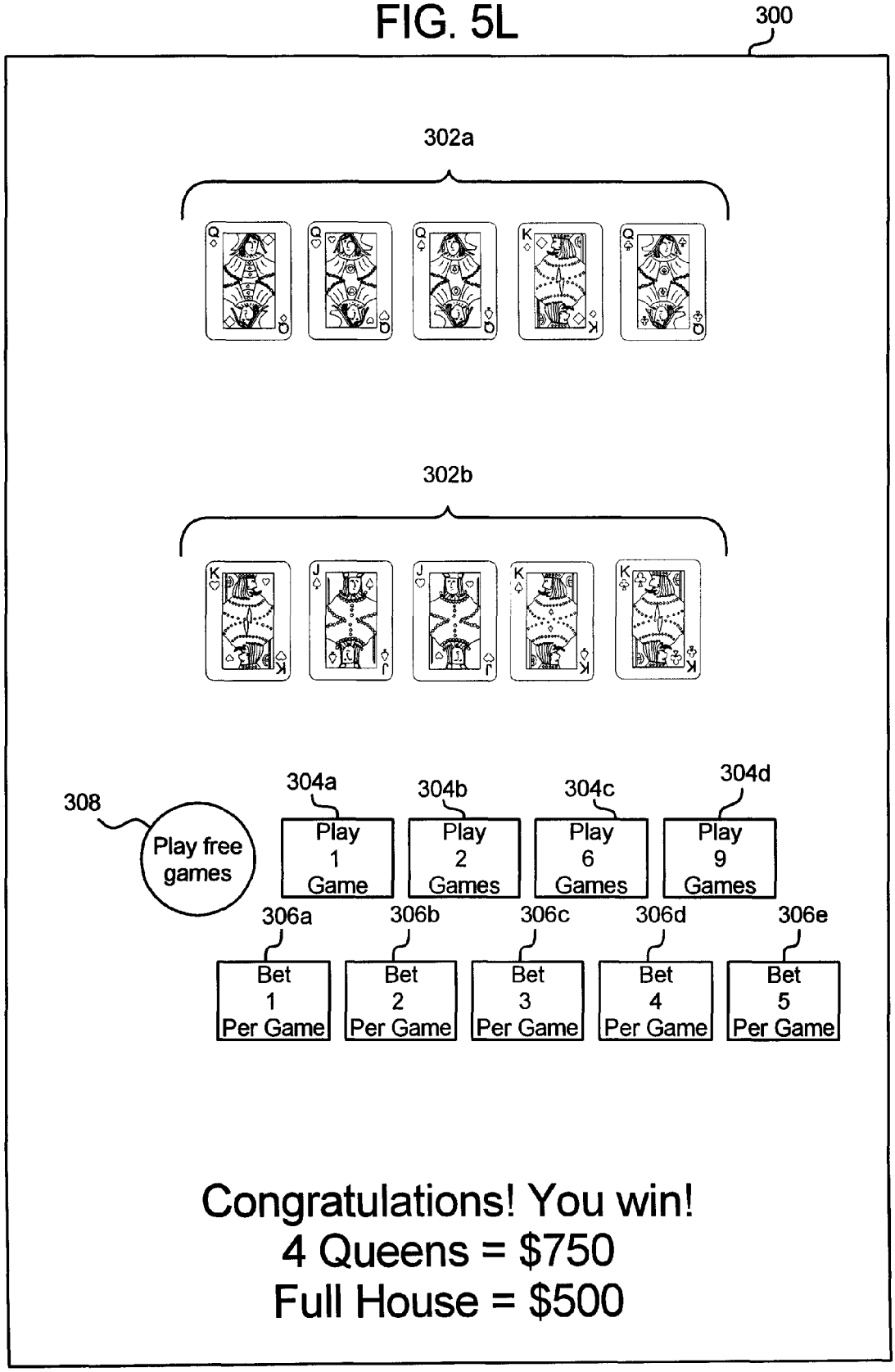

As illustrated in FIG. 5L, the gaming system generates and displays new cards to replace the discarded cards in the two poker games. In the first game, the gaming system generates a queen of diamonds and a queen of clubs. The player receives an award of $750 for the four of a kind queen poker hand. In the second game, the gaming system generates and displays a king of hearts and a king of clubs. The gaming system provides the player an award of $500 for the full house. The player is out of free games.

In another embodiment, the games are a plurality of hands of poker. In one such game, the player is dealt a primary hand and a same plurality of remaining hands such that the number of hands equals the number of games selected by the player. That is, each hand of cards, the primary hand and the remaining hands, each includes the same cards. The player chooses the cards to hold, if any, in the primary hand. The held cards in the primary hand are also held in each of the remaining hands of cards. After holding zero, one or more cards in the primary hand (and thus holding zero, one or more of the same cards in each of the remaining hands), the gaming system removes the remaining non-held playing cards from each of the hands of cards. For each hand of cards, a replacement card is independently dealt for each removed, non-held playing card, wherein each hand of cards is associated with its own deck of cards. Each individual poker hand is compared, hand by hand, to a payout table which utilizes conventional poker hand rankings to determine the award, if any, associated with each of the individual poker hands. A total award based on any of the determined awards is provided to the player.

In this embodiment, the free game triggering event may be any suitable event. In one embodiment, for each round of game play the round only includes one primary hand and the wagering games and free games played during the round are based on that primary hand. In another embodiment, the round of game play includes a primary hand for the wagering games and a separate primary hand for the free games. Therefore, if the player is playing wagering games simultaneously with free games, the player will receive two different primary hands.

In alternative embodiments of this embodiment, (i) the same cards are initially dealt or displayed for each of the individual hands of cards, or (ii) playing cards are only dealt or displayed for a primary hand and the remaining simultaneously played hands do not initially display any individual playing cards.

It should be appreciated that the free games may be any suitable type of game. It should also be appreciated that in one embodiment, the free games have one or more advantages over the wagering games. That is, a free game provides a player a benefit that the wagering game does not. It should be appreciated that the free games may be different than the wagering games in any suitable manner or characteristic. For example, the free games may have a different: (i) paytable than the paytables employed in the wagering games; (ii) volatility than the volatility of the wagering games; (iii) average expected payback percentage than the average expected payback percentages of the wagering games; (iv) eligibility for a progressive award than the wagering games; (vi) modifier or multiplier than a multiplier employed by of the wagering games; (vii) type or kind of the bonus game than the bonus games of the of the wagering games; (viii) more paylines or more winning combinations than the wagering games; or (ix) any combination of these.

In one embodiment, the gaming system enables the player to wager a different amount for each of the wagering games. That is, instead of wagering a same amount per game, the gaming system enables the player to wager different amounts for the games. In one embodiment, the player can place a wager amount and designate portions of the wager amount for the different wagering games.

In one embodiment, the gaming system enables the player to wager one amount for the wagering games and another amount for the free games. In one embodiment, the wager for the triggering game does not affect any of the triggered free games. That is, the wager includes a first wager for the wagering games and a second wager for any free games. The second wager then is applied to all of the free games triggered upon a play of that gaming system. For example, the player wagers $3 on the played games and then $5 for any free games. The award from any free game triggered from any of the other games is based on the $5 free game wager.

In one embodiment, each game includes or is associated with a wager amount display. When the player is playing the game, the wager amount display displays the amount wagered for that game. In one embodiment, each game includes or is associated with an award display. Upon a winning combination, the award display displays the award provided to the player for that game.

In one embodiment, the wagering games are played simultaneously. In another embodiment, the gaming system enables a player to wager on an additional wagering game at any time. That is, while the player is playing one or more free games and/or one or more wagering games, the player may select and wager on more wagering games or initiate play of a provided free game.

It should be appreciated that the gaming system may include any game operable upon a wager. In one embodiment, all of the games are the same. In another embodiment, one or more of the games are different games. The games may be any suitable game, such as, but not limited to, slots, poker, bunco, checkers, blackjack, roulette, keno, bingo, craps and any combination of these or any other suitable random game which results in awards. In one embodiment, each of the wagering games is the same game with a different free game triggering event. That is, a different event in each of the same wagering games triggers the free game associated with that free game triggering event. In one embodiment, one or more of the wagering games is a different game and is associated with one or more different free game triggering events.

In one embodiment, all of the games (including wagering games and free games) are associated with a free game triggering event and thus can trigger a free game. In another embodiment, less than all of the games (including wagering games and free games) are associated with a free game triggering event and only some of the games may trigger free games. In various embodiments, one, a plurality or all of the wagering games and/or free games are each associated with a plurality of free game triggering events.

In an alternative embodiment, the triggering event is associated with or triggered by a plurality of games. That is, one or more games combined produces the free game triggering event. For example, the free game triggering event is the combination of: two cherries in one slot game, three stars in another slot game and two sevens in another slot game. Accordingly, the gaming system only provides free games when three or more of the slot games are being played and the slot games generate the triggering symbol combinations.

In one embodiment, each free game triggering event is associated with one or more free games. That is, upon an occurrence of the free game triggering event, the player receives one or more of the free games associated with that triggering event. In another embodiment, each free game triggering event is only associated with a number of games and the player selects which free games to play.

It should be appreciated that the gaming machine may enable the player to play the free games in any suitable manner. The gaming machine may automatically play a plurality or all of the free games in the next play of the gaming machine. In another embodiment, the gaming machine enables the player to determine how many free games to simultaneously play. That is, when a player is provided free games, the player determines how many free games they want to play in a next play of the game.

In another embodiment, the gaming machine or gaming system enables the player to simultaneously play all of the won free games. For example, the maximum number of games the player may simultaneously play on a gaming machine or system is 21. If the player wins four free games in a first round of game play, the gaming machine enables the player to play the four free games and to wager on 17 wagering games in a second round of game play.

In another embodiment, the gaming machine includes a plurality of different free games and enables the player to select the free game to play. In one embodiment, if a player wins multiple free games, the gaming machine enables the player to select a single type of game for the multiple free games and play all of the free games as the selected type of game. In another embodiment, if a player wins multiple free games, the gaming machine enables the player to select multiple games for the multiple free games. That is, the player selects the type of game for each free game provided to the player.

In another embodiment, the gaming machine enables the player to pick an overall number of games to play. The gaming machine only requires the player's wager amount to cover the difference between the overall number of games minus any available free games. For example, a player has three free games and selects 9 games to play at 3 credits a game. To initiate the game, the player only needs to place a wager of 18 $((9-3)\times3)$ credits to play the 9 games. The gaming machine automatically utilizes the free games.

In one embodiment, the gaming machine includes a plurality of different games and the free game associated with the free game triggering event is the same game as the triggering wagering game. That is, any free games won or triggered by the wagering games result in that same free game. For example, if the player won free games from a blackjack game, the free games provided to the player are blackjack games.

The gaming machine may determine the number of free games to provide a player for the occurrence of each free game triggering event in any suitable manner. In one embodiment, each free game triggering event is associated with a number of games. In another embodiment, the gaming machine determines the number of free games to provide to a player based on the amount the player wagered on the triggering wagering game.

It should be appreciated that the central display may display the games being played as free games and/or the games being played as wagering games. For example, in one embodiment, the gaming system displays all games being played as wagering games on the central display and provides players individual free games to play on the individual player stations. In this embodiment, the players would be playing wagering games and free games simultaneously based on the central display and the individual display device of the player station. In another embodiment, the gaming system enables players to play the games of the central display as free games. Therefore, the players would be playing the wagering games and free games on the central display. Some players may be playing a same play of a game a wagering game while other players are playing the same game of the game as a free game. It should be appreciated that the games may be displayed in any suitable manner.

While the present disclosure is described in connection with what is presently considered to be the most practical and preferred embodiments, it should be appreciated that the present disclosure is not limited to the disclosed embodiments, and is intended to cover various modifications and equivalent arrangements included within the spirit and scope of the claims. Modifications and variations in the present disclosure may be made without departing from the novel aspects of the invention as defined in the claims, and this application is limited only by the scope of the claims.

The invention claimed is:

1. A method of operating a gaming system, said method comprising:

(a) causing at least one processor to operate with at least one display device and at least one input device, for a first round of game play, to:
  (i) enable a player to play a first game by placing a first wager amount on a first play of the first game,
  (ii) enable the player to play a second game by placing the first wager amount on a first play of the second game,
  (iii) simultaneously display the first play of the first game and the first play of the second game,
  (iv) for said displayed first play of the first game in the first round of game play, determine any award for said play based on said first wager amount,
  (v) for said displayed first play of the second game in the first round of game play, determine any award for said play based on the first wager amount, and
  (vi) display any determined awards; and (b) causing the at least one processor to operate with the at least one display device and the at least one input device, for a second round of game play, to:
  (i) enable the player to play the first game by placing a second wager amount on a second play of the first game, said second wager amount being different than said first wager amount,
  (ii) if the player wins a quantity of free plays of the second game in association with the first play of the second game in the first round of game play:
    (1) enable the player to play one of said free plays of the second game without requiring the player to place any wager amount for said free play of the second game,
    (2) simultaneously display said free play of the second game and the second play of the first game,
    (3) for said displayed second play of the first game in the second round of game play, determine any award for said play based on said second wager amount, and
    (4) for said displayed free play of the second game in the second round of game play, determine any award for said play based on the first wager amount placed in the first round of game play, and
  (iii) display any said determined awards.

2. The method of claim 1, which includes causing the at least one processor to operate with the at least one display device and the at least one input device, if the player does not win the quantity of free plays of the second game, to receive the second wager amount on said second play of said second game from the player to play a second play of the second game in said second round of game play.

3. The method of claim 1, which includes causing the at least one processor to operate with the at least one display device and the at least one input device to repeat (b)(i) to (b)(iii) for a subsequent round of game play.

4. The method of claim 1, which includes causing the at least one processor to operate with the at least one display device and the at least one input device to repeat (b)(i) to (b)(iii) for each of the quantity of won and unplayed free plays of the second game.

5. The method of claim 1, which includes causing the first game and the second game to be different types of games.

6. The method of claim 1, which includes causing the free plays of the second game to include an advantage over the first play of the second game.

7. The method of claim 1, which includes providing the player the quantity of free plays based on an occurrence of a free game triggering event from a plurality of different free game triggering events in association with the first play of the second game.

8. The method of claim 7, which includes causing each free game triggering event to be associated with one of a plurality of different quantities of free games.

9. The method of claim 1, which includes causing the at least one processor to determine the quantity of free games won based on the first wager amount.

10. The method of claim 1, which includes causing the at least one processor to operate with the at least one display device and the at least one input device to provide any determined awards to said player.

11. The method of claim 1, which is provided through a data network.

12. The method of claim 11, wherein the data network is the internet.

13. A method of operating a gaming system, said method comprising:

(a) causing at least one processor to operate with at least one display device and at least one input device, for a first round of game play, to:
  (i) enable a player to play a first game from a plurality of games by placing a first wager amount on a first play of the first game,
  (ii) enable the player to play a second game from the plurality of games by placing the first wager amount on a first play of the second game,
  (iii) simultaneously display the first play of the first game and the first play of the second game,
  (iv) for the displayed first play of the first game in the first round of game play, determine any award for said play based on said first wager amount,
  (v) for the displayed first play of the second game in the first round of game play, determine any award for said play based on the first wager amount, and
  (vi) display any determined awards; and (b) causing the at least one processor to operate with the at least one display device and the at least one input device, for a second round of game play, to:

(i) enable the player to play the first game by placing a second wager amount on a second play of the first game, said second wager amount being different than said first wager amount, (ii) if the player wins a quantity of free plays of the games in association with the first play of the second game in the first round of game play, said quantity being at least two:

(1) enable the player to select one of a plurality of different numbers of the quantity of free plays of the games to simultaneously play and enable the player to play said player selected number of free plays on a remaining plurality of the games without requiring the player to place any wager amounts for said free plays, (2) simultaneously display the second play of the first game and each of the player selected number of free plays of the games, (3) for the second play of the first game played in the second round of game play, determine any award for said play based on said second wager amount placed on said play, and (4) for each free play of one of the games played in the second round of game play, determine any award for said play based on the first wager amount placed in the first round of game play; and (iii) display any said determined awards.

14. The method of claim 13, which includes causing the first game and the second game to be different types of games.

15. The method of claim 13, which includes causing the free plays to include an advantage over the first play of the first game, the second play of the first game and the first play of the second game.

16. The method of claim 13, which includes providing the player the quantity of free plays based on an occurrence of a free game triggering event from a plurality of different free game triggering events in association with the first play of the second game.

17. The method of claim 16, which includes causing each free game triggering event to be associated with one of a plurality of different quantities of free games.

18. The method of claim 13, which includes causing the at least one processor to determine the quantity of free games won based on the first wager amount.

19. The method of claim 18, wherein the data network is the internet.

20. The method of claim 13, which includes causing the at least one processor to operate with the at least one display device and the at least one input device to provide any determined awards to said player.

21. The method of claim 13, which is provided through a data network.

* * * * *

UNITED STATES PATENT AND TRADEMARK OFFICE

CERTIFICATE OF CORRECTION

PATENT NO. : 8,246,443 B2
APPLICATION NO. : 12/786744
DATED : August 21, 2012
INVENTOR(S) : Dov Liam Randall It is certified that error appears in the above-identified patent and that said Letters Patent is hereby corrected as shown below:

IN THE CLAIMS

In Column 30, Claim 2, Line 8, replace the first instance of "said" with --a--.
In Column 30, Claim 2, Line 9, replace "a" with --the--.
In Column 32, Claim 19, Line 18, replace "18" with --21--.

Signed and Sealed this
Eighth Day of January, 2013

David J. Kappos

David J. Kappos
*Director of the United States Patent and Trademark Office*